US011152728B2

(12) United States Patent
Hashiguchi

(10) Patent No.: US 11,152,728 B2
(45) Date of Patent: Oct. 19, 2021

(54) CONNECTOR AND CONNECTING METHOD

(71) Applicant: Japan Aviation Electronics Industry, Limited, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/994,051

(22) Filed: Aug. 14, 2020

(65) Prior Publication Data

US 2021/0126393 A1 Apr. 29, 2021

(30) Foreign Application Priority Data

Oct. 24, 2019 (JP) ..... JP2019-193203

(51) Int. Cl.
*H01R 12/78* (2011.01)
*H01R 13/11* (2006.01)
*H01R 13/502* (2006.01)

(52) U.S. Cl.
CPC ..... *H01R 12/78* (2013.01); *H01R 13/11* (2013.01); *H01R 13/502* (2013.01)

(58) Field of Classification Search
CPC .. A41D 1/005; H01R 13/2471; H01R 13/665; H01R 13/78; H01R 13/11; H01R 13/502
See application file for complete search history.

(56) References Cited

U.S. PATENT DOCUMENTS 9,893,478 B2 * 2/2018 Komoto ..... A41D 1/005
10,096,918 B1 * 10/2018 Nakamura ..... H01R 13/502
10,109,963 B2 * 10/2018 Komoto ..... H01R 13/5219
10,498,097 B2 * 12/2019 Komoto ..... H01R 13/5202
2002/0160648 A1 * 10/2002 Bulmer ..... H01R 12/675 439/393
2006/0280322 A1 * 12/2006 Abe ..... H01R 13/24 381/300
2009/0088652 A1 * 4/2009 Tremblay ..... A61B 5/6814 600/388

(Continued)

FOREIGN PATENT DOCUMENTS

JP 2018129244 A 8/2018

*Primary Examiner* — Abdullah A Riyami
*Assistant Examiner* — Nader J Alhawamdeh
(74) *Attorney, Agent, or Firm* — Muncy, Geissler, Olds & Lowe. P.C.

(57) ABSTRACT

A connector includes a contact member having a contact, and an elastic member having an elastic member body and a rotation operating portion, the contact member having a conductor-contact portion formed of part of the contact and an elastic member-contact portion disposed to be separated from the conductor-contact portion in a predetermined direction, the elastic member body having a base portion joined to the rotation operating portion and a pressing portion disposed to be separated from the base portion in the predetermined direction and being elastically displaceable in the predetermined direction, part of the flexible conductor being disposed between the pressing portion and the conductor-contact portion, the base portion coming into contact with the elastic member-contact portion, and the pressing portion elastically displaced pressing the part of the flexible conductor against the conductor-contact portion, whereby the contact is electrically connected to the flexible conductor.

19 Claims, 19 Drawing Sheets

(56) References Cited

U.S. PATENT DOCUMENTS

| | | | | |
|---|---|---|---|---|
| 2017/0209738 | A1* | 7/2017 | Brennan | A41D 1/005 |
| 2017/0279230 | A1* | 9/2017 | Komoto | H01R 13/73 |
| 2018/0212359 | A1* | 7/2018 | Wei | H05K 1/181 |
| 2018/0233854 | A1* | 8/2018 | Komoto | H01R 13/629 |

* cited by examiner

FIG. 5
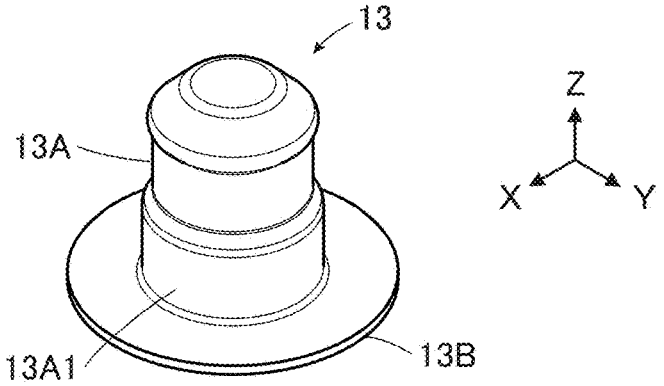
FIG. 6
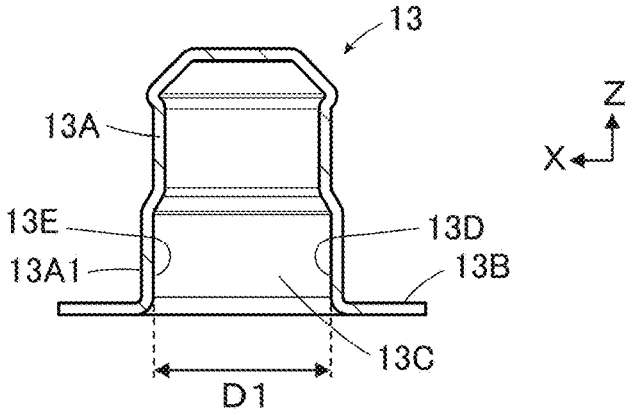
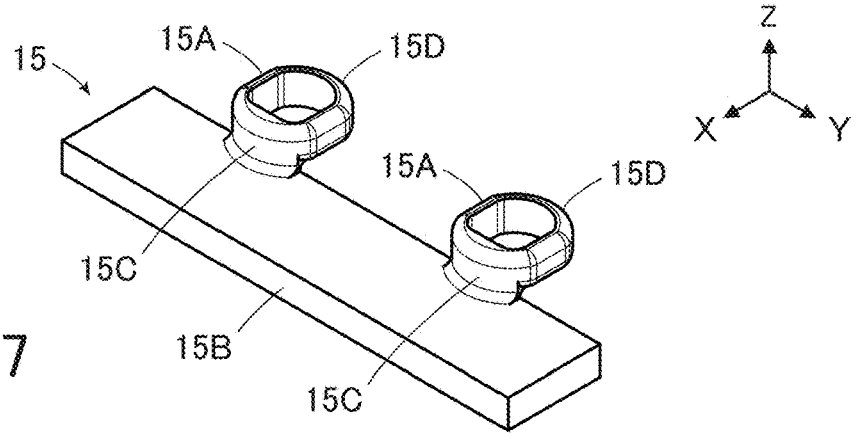
FIG. 7

FIG. 8
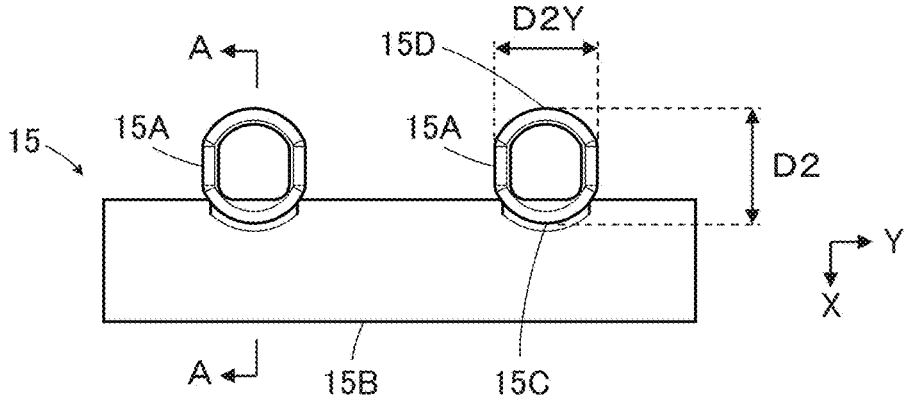
FIG. 9
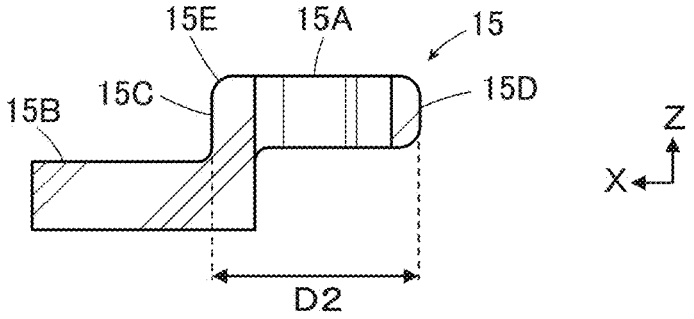
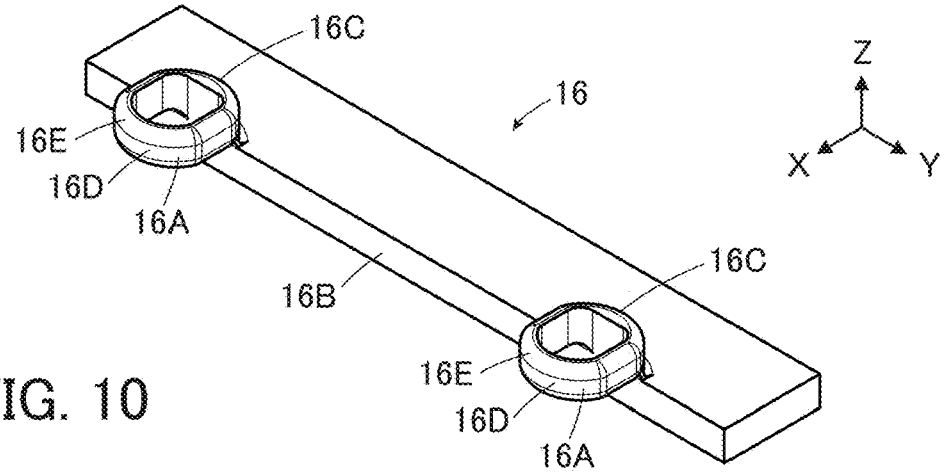
FIG. 10

CONNECTOR AND CONNECTING METHOD

BACKGROUND OF THE INVENTION

The present invention relates to a connector and a connecting method, particularly to a connector to be connected to a flexible conductor.

As the connector to be connected to a flexible conductor, for example, JP2018-129244A discloses a connector as illustrated in FIG. 41. This connector includes a contact 2 and a base member 3 that are disposed on the opposite sides across a flexible substrate 1 to sandwich the flexible substrate 1 therebetween.

A flexible conductor 4 is exposed on the front surface of the flexible substrate 1 with the front surface facing the contact 2, the contact 2 has a projection accommodating portion 5 of recess shape formed to face the flexible conductor 4, and a projection 6 is formed on the base member 3 to project toward the rear surface of the flexible substrate 1. When the projection 6 of the base member 3, together with the flexible substrate 1, is inserted into the projection accommodating portion 5 of the contact 2 with the flexible substrate 1 being sandwiched between the projection 6 and the contact 2 such that the projection 6 is covered by the flexible substrate 1, the flexible substrate 1 is pressed against the inner surface of the projection accommodating portion 5 of the contact 2 by the projection 6, and accordingly the inner surface of the projection accommodating portion 5 contacts the flexible conductor 4 exposed on the front surface of the flexible substrate 1 with a predetermined contact force, whereby the contact 2 is electrically connected to the flexible conductor 4.

Meanwhile, when the projection 6 of the base member 3 together with the flexible substrate 1 is inserted into the projection accommodating portion 5 of the contact 2, the flexible substrate 1 receives from the projection 6 a large force which turns to be a predetermined contact force between the flexible conductor 4 and the inner surface of the projection accommodating portion 5 when connected and rubs the inner surface of the projection accommodating portion 5 to be inserted. Accordingly, the flexible conductor 4 disposed on the front surface of the flexible substrate 1 may be damaged, and reliability of electrical connection between the flexible conductor 4 and the contact 2 may be impaired.

SUMMARY OF THE INVENTION

The present invention has been made to solve the foregoing problem and aims at providing a connector that can prevent damage to a flexible conductor at the time of connection and can ensure reliability of electrical connection to the flexible conductor.

The present invention also aims at providing a connecting method for electrically connecting a contact to a flexible conductor while the flexible conductor is prevented from being damaged.

A connector according to the present invention is a connector to be connected to a flexible conductor, the connector comprising:

a contact member including a contact made of a conductive material; and an elastic member including an elastic member body and a rotation operating portion extending from the elastic member body, wherein the contact member includes a conductor-contact portion formed of part of the contact and an elastic member-contact portion disposed to be separated from the conductor-contact portion in a predetermined direction and facing the conductor-contact portion, wherein the elastic member body includes a base portion joined to the rotation operating portion and a pressing portion disposed to be separated from the base portion in the predetermined direction and being elastically displaceable in the predetermined direction with respect to the base portion, and wherein part of the flexible conductor is disposed between the pressing portion of the elastic member body and the conductor-contact portion of the contact member, the base portion of the elastic member body comes into contact with the elastic member-contact portion of the contact member, and the pressing portion elastically displaced in the predetermined direction presses the part of the flexible conductor against the conductor-contact portion, whereby the contact is electrically connected to the flexible conductor.

A connecting method according to the present invention is a connecting method for connecting a contact of a contact member to a flexible conductor with use of an elastic member, the contact member including a conductor-contact portion constituted by part of the contact and an elastic member-contact portion disposed to be separated from the conductor-contact portion in a predetermined direction, the elastic member including an elastic member body and a rotation operating portion joined to the elastic member body, the elastic member body having a base portion and a pressing portion disposed to be separated from the base portion in the predetermined direction and being elastically displaceable in the predetermined direction with respect to the base portion, the connecting method comprising:

disposing the flexible conductor with respect to the contact member such that part of the flexible conductor is situated near the conductor-contact portion;

disposing the elastic member obliquely with respect to the contact member such that the pressing portion contacts the part of the flexible conductor and that the part of the flexible conductor is sandwiched between the conductor-contact portion and the pressing portion; and rotating the elastic member about the pressing portion that is in contact with the part of the flexible conductor through an operation of the rotation operating portion to bring the base portion of the elastic member body into contact with the elastic member-contact portion of the contact member so that the pressing portion elastically displaced presses the part of the flexible conductor against the conductor-contact portion, whereby the contact is electrically connected to the flexible conductor.

BRIEF DESCRIPTION OF THE DRAWINGS

FIG. 5 is a perspective view showing a contact used in the connector according to Embodiment 1.

FIG. 6 is a cross-sectional view of the contact used in the connector according to Embodiment 1.

FIG. 7 is a perspective view showing one of elastic members used in the connector according to Embodiment 1.

FIG. 8 is a plan view showing the one of the elastic members used in the connector according to Embodiment 1.

FIG. 9 is a cross-sectional view taken along line A-A in FIG. 8.

FIG. 10 is a perspective view showing the other of the elastic members used in the connector according to Embodiment 1.

DETAILED DESCRIPTION OF THE INVENTION

Embodiments of the present invention are described below with reference to the accompanying drawings.

Embodiment 1

Figure 1:
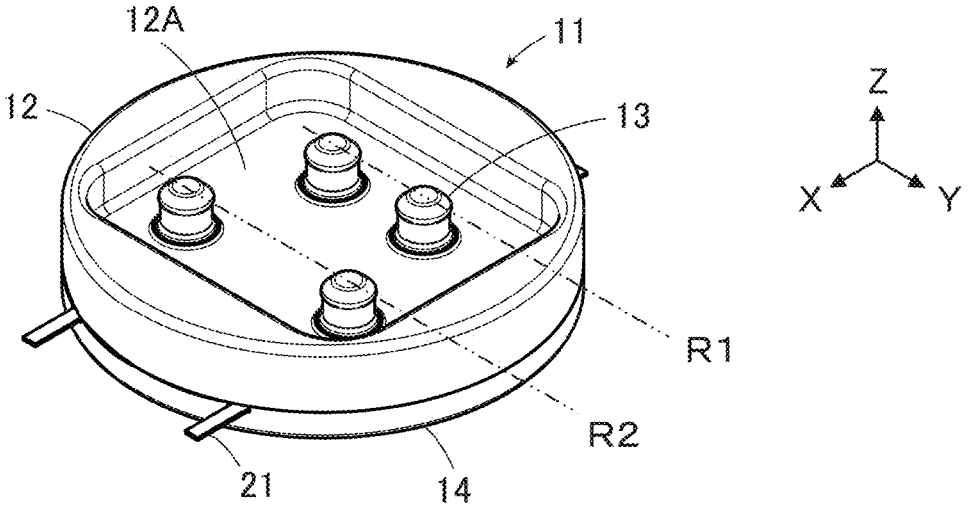
FIG. 1 is a perspective view of a connector according to Embodiment 1 of the present invention when viewed from an obliquely upper position.
Figure 2:
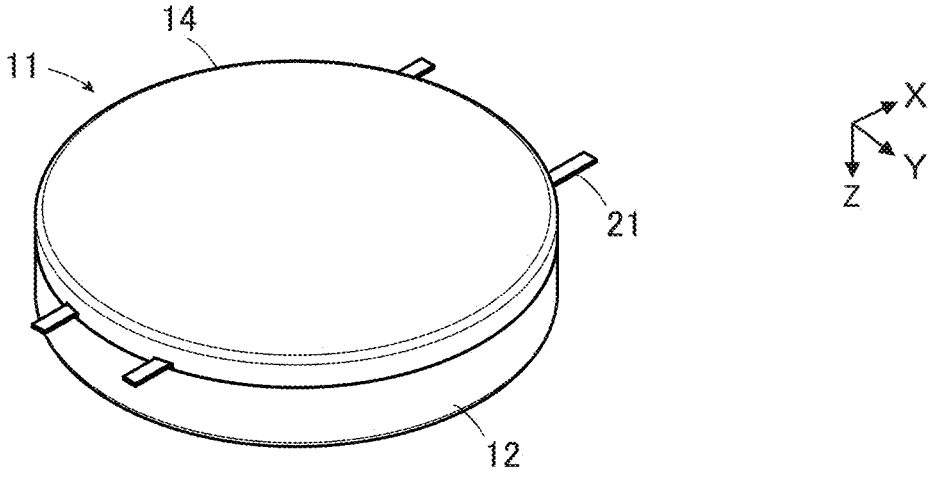
FIG. 2 is a perspective view of the connector according to Embodiment 1 when viewed from an obliquely lower position.

FIGS. 1 and 2 illustrate a connector 11 according to Embodiment 1. The connector 11 is used as, for example, a garment-side connector portion for fitting a wearable device and is connected to a plurality of flexible conductors 21.

The connector 11 includes a first insulator 12, four contacts 13 and a second insulator 14 that faces the first insulator 12 with four flexible conductors 21 being sandwiched therebetween, and the four contacts 13 are electrically connected to the four flexible conductors 21 in a one-by-one manner. The first insulator 12 includes a recess 12A, and in the recess 12A of the first insulator 12, the contacts 13 project perpendicularly to a flat bottom surface of the recess 12A.

The flexible conductors 21 are each produced using a band-like conductor formed by twisting a plurality of conductive fibers.

For convenience, the bottom surface of the recess 12A of the first insulator 12 is defined as extending along an XY plane, and the direction in which the contacts 13 project is referred to as "+Z direction."

The four flexible conductors 21 are disposed on the −Z direction side of the first insulator 12, and the second insulator 14 is disposed on the −Z direction side of the four flexible conductors 21.

The four contacts 13 are arranged in two rows including a first row R1 and a second row R2. Each of the first row R1 and the second row R2 extends along the Y direction and is composed of a pair of contacts 13 adjoining each other. In addition, the first row R1 and the second row R2 are separated from each other in the X direction, and the second row R2 is disposed on the +X direction side of the first row R1.

Figure 3:
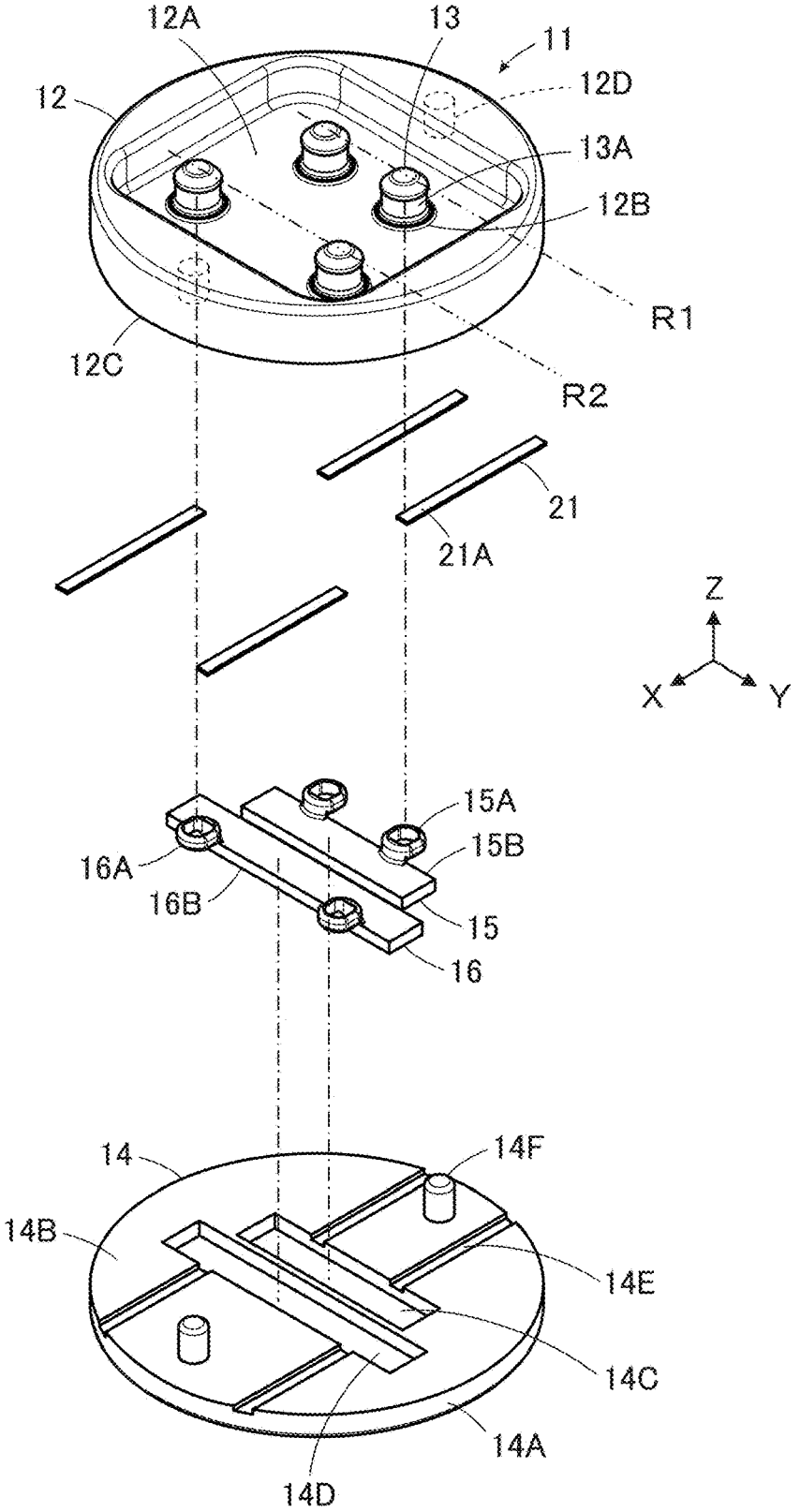
FIG. 3 is an assembly view of the connector according to Embodiment 1 when viewed from an obliquely upper position.
Figure 4:
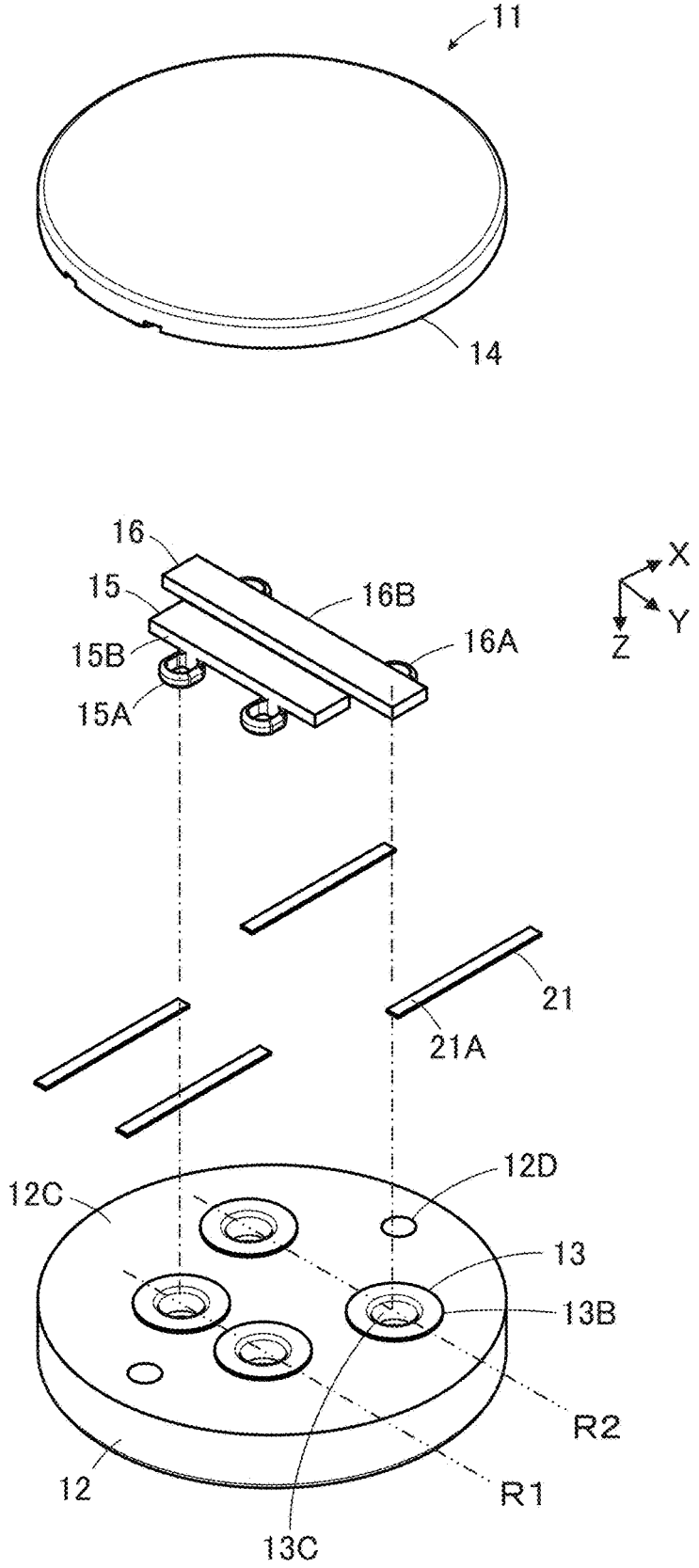
FIG. 4 is an assembly view of the connector according to Embodiment 1 when viewed from an obliquely lower position.

FIGS. 3 and 4 illustrate assembly views of the connector 11. The first insulator 12 is made of an insulating resin, and within the recess 12A opening toward the +Z direction, four contact through-holes 12B are formed. The recess 12A constitutes a counter connector-accommodating portion in which part of a counter connector (not shown) is to be accommodated. Into the four contact through-holes 12B, the contacts 13 are independently inserted. In addition, two post accommodating portions 12D of recess shape are formed outside the recess 12A in the XY direction on a surface 12C of the first insulator 12, which surface 12C faces in the −Z direction.

The four contacts 13 are plug-type contacts made of a conductive material such as metal, constitute contact members used in Embodiment 1 and are to be connected to corresponding contacts of a counter connector (not shown) when part of the counter connector is accommodated in the recess 12A of the first insulator 12.

The four flexible conductors 21 are disposed on the −Z direction side of the first insulator 12, and two elastic members 15 and 16 are disposed on the −Z direction side of the four flexible conductors 21.

The elastic member 15 corresponds to the pair of contacts 13 constituting the first row R1, and the elastic member 16 corresponds to the pair of contacts 13 constituting the second row R2. The elastic member 15 includes two elastic member bodies 15A and one rotation operating portion 15B joined to the two elastic member bodies 15A. Similarly, the elastic member 16 includes two elastic member bodies 16A and one rotation operating portion 16B joined to the two elastic member bodies 16A. The elastic members 15 and 16 are formed of an elastically deformable resin or metal.

The second insulator 14 is disposed on the −Z direction side of the two elastic members 15 and 16. The second insulator 14 is made of an insulating resin and includes a flat plate portion 14A. On a surface 14B of the flat plate portion 14A, which surface 14B faces in the +Z direction, two elastic member-corresponding recesses 14C and 14D separately corresponding to the two elastic members 15 and 16 are formed, and two conductor accommodating grooves 14E communicating with the elastic member-corresponding recess 14C as well as two conductor accommodating grooves 14E communicating with the elastic member-corresponding recess 14D are formed. The conductor accommodating grooves 14E are used to accommodate the corresponding flexible conductors 21.

In addition, two fixing posts 14F are formed on and project from the surface 14B of the flat plate portion 14A. The two fixing posts 14F correspond to the two post accommodating portions 12D of recess shape of the first insulator 12.

Two contacts 13 which are inserted into, among the four contact through-holes 12B of the first insulator 12, two contact through-holes 12B disposed on the −X direction side and which constitute the first row R1, contact portions 21A of, among the four flexible conductors 21, two flexible conductors 21 disposed on the −X direction side, and two elastic member bodies 15A of the elastic member 15 are positionally aligned with each other in the Z direction.

Similarly, two contacts 13 which are inserted into, among the four contact through-holes 12B of the first insulator 12, two contact through-holes 12B disposed on the +X direction side and which constitute the second row R2, contact portions 21A of, among the four flexible conductors 21, two flexible conductors 21 disposed on the +X direction side, and two elastic member bodies 16A of the elastic member 16 are positionally aligned with each other in the Z direction.

In addition, the two post accommodating portions 12D of the first insulator 12 and the two fixing posts 14F of the second insulator 14 are positionally aligned with each other in the Z direction.

FIGS. 5 and 6 illustrate the contact 13 arranged in the first row R1. The contact 13 has a projection portion 13A of cylindrical tube shape extending in the Z direction and a flange 13B of circular disc shape extending from the −Z directional end of the projection portion 13A along an XY plane. A large diameter portion 13A1 having a larger diameter than that of a +Z direction portion of the projection portion 13A is provided at a −Z direction portion of the projection portion 13A, and an elastic member body-accommodating portion 13C of recess shape opening toward the −Z direction is formed inside the large diameter portion 13A1. The elastic member body-accommodating portion 13C has an inside diameter D1, an inner surface of the elastic member body-accommodating portion 13C at the −X directional end forms a conductor-contact portion 13D which contacts the contact portion 21A of the flexible conductor 21, and an inner surface of the elastic member body-accommodating portion 13C at the +X directional end forms an elastic member-contact portion 13E which contacts the elastic member 15.

The contact 13 arranged in the second row R2 has a similar configuration to the contact 13 arranged in the first row R1 but has the conductor-contact portion 13D and the elastic member-contact portion 13E positionally reversed in the X direction; the inner surface of the elastic member body-accommodating portion 13C at the +X directional end forms the conductor-contact portion 13D which contacts the contact portion 21A of the flexible conductor 21, and the inner surface of the elastic member body-accommodating portion 13C at the −X directional end forms the elastic member-contact portion 13E which contacts the elastic member 16.

The contact 13 as above can be manufactured by, for example, press working, cutting or drawing.

The contact through-hole 12B of the first insulator 12 has an inside diameter larger than the outside diameter of the large diameter portion 13A1 of the projection portion 13A of the contact 13 and smaller than the outside diameter of the flange 13B. As illustrated in FIG. 3, the projection portions 13A of the contacts 13 penetrate through the contact through-holes 12B to project inside the recess 12A of the first insulator 12, and as illustrated in FIG. 4, the flanges 13B of the contacts 13 are exposed on the surface 12C of the first insulator 12, which surface 12C faces in the −Z direction.

FIGS. 7 to 9 illustrate the elastic member 15 corresponding to the two contacts 13 arranged in the first row R1. The elastic member 15 includes the two elastic member bodies 15A arranged side by side in the Y direction and the one rotation operating portion 15B joined to the two elastic member bodies 15A. A distance between centers of the two elastic member bodies 15A in the Y direction is set to be equal to a distance between centers of the two contacts 13 constituting the first row R1 in the Y direction.

Each elastic member body 15A has a ring-like shape extending on an XY plane, a base portion 15C is provided at the +X directional end of the elastic member body 15A, and a pressing portion 15D which is elastically displaceable in the X direction (predetermined direction) with respect to the base portion 15C is provided at the −X directional end of the elastic member body 15A, being separated from the base portion 15C in the X direction (predetermined direction).

The pressing portion 15D presses the contact portion 21A of the flexible conductor 21 against the conductor-contact portion 13D of the corresponding contact 13 to thereby electrically connect the flexible conductor 21 to the contact 13.

An external dimension D2 of the ring-like elastic member body 15A in the X direction is set to be larger than a value obtained by subtracting a thickness of the flexible conductor 21 from the inside diameter D1 of the elastic member body-accommodating portion 13C of the contact 13.

Meanwhile, an external dimension D2Y of the elastic member body 15A in the Y direction has a smaller value than the external dimension D2 in the X direction.

The rotation operating portion 15B is joined to the base portions 15C of the two elastic member bodies 15A on the −Z direction side. The rotation operating portion 15B extends in the Y direction across the two elastic member bodies 15A at a position separated away in the −Z direction from an XY plane along which the elastic member bodies 15A extend, and has a flat plate shape extending from the base portions 15C of the two elastic member bodies 15A in the +X direction, i.e., the opposite direction to the pressing portions 15D. The rotation operating portion 15B is used to rotate the two elastic member bodies 15A about a Y axis at a time.

As illustrated in FIG. 9, the ring-like elastic member body 15A is provided with a curved surface 15E at its +Z directional edge and −Z directional edge.

FIG. 10 illustrates the elastic member 16 corresponding to the two contacts 13 constituting the second row R2. As with the elastic member 15, the elastic member 16 includes the two elastic member bodies 16A arranged side by side in the Y direction and the one rotation operating portion 16B joined to the two elastic member bodies 16A. However, the positional relationship between the elastic member bodies 16A and the rotation operating portion 16B in the X direction is opposite to that of the elastic member 15; the rotation operating portion 16B is joined to the two elastic member bodies 16A on the −X direction side. A distance between centers of the two elastic member bodies 16A in the Y direction is set to be equal to a distance between centers of the two contacts 13 constituting the second row R2 in the Y direction.

While each elastic member body 16A has a similar configuration to that of the elastic member body 15A of the elastic member 15, a base portion 16C is provided at the −X directional end of the elastic member body 16A, and a pressing portion 16D is provided at the +X directional end of the elastic member body 16A. The elastic member body 16A has the same external dimension D2 in the X direction and the same external dimension D2Y in the Y direction as those of the elastic member body 15A of the elastic member 15.

The rotation operating portion 16B joined to the base portions 16C of the two elastic member bodies 16A extends in the Y direction across the two elastic member bodies 16A at a position separated away in the −Z direction from an XY plane along which the elastic member bodies 16A extend, and has a flat plate shape extending from the base portions 16C of the two elastic member bodies 16A in the −X direction, i.e., the opposite direction to the pressing portions 16D. The rotation operating portion 16B is used to rotate the two elastic member bodies 16A about a Y axis at a time.

As with the elastic member body 15A of the elastic member 15, the ring-like elastic member body 16A is provided with a curved surface 16E at its +Z directional edge and −Z directional edge.

Figure 11:
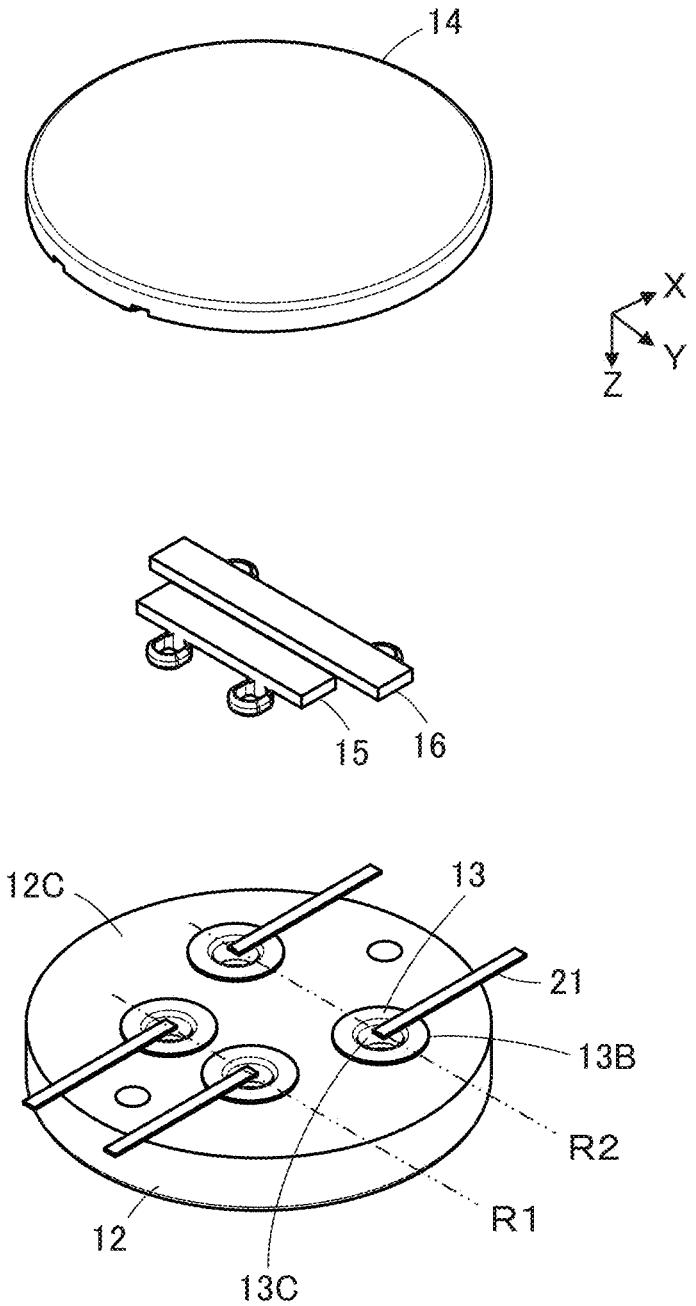
FIG. 11 is an assembly view of the connector when flexible conductors are disposed on a first insulator in which the contacts are fitted.

For connecting the connector 11 to the plurality of flexible conductors 21, first, the projection portions 13A of the four contacts 13 are inserted into the four contact through-holes 12B of the first insulator 12. At this time, as illustrated in FIG. 11, the flanges 13B of the four contacts 13 are exposed on the surface 12C of the first insulator 12, which surface 12C faces in the −Z direction.

Next, the four flexible conductors 21 are disposed on the surface 12C of the first insulator such that the contact portions 21A of the flexible conductors 21 are separately situated on the elastic member body-accommodating portions 13C of recess shape of the corresponding contacts 13. At this time, to the elastic member body-accommodating portions 13C of the two contacts 13 constituting the first row R1, the corresponding flexible conductors 21 extend from the −X direction side in the +X direction, and the contact portions 21A provided at the +X directional ends of the flexible conductors 21 are situated on the elastic member body-accommodating portions 13C of the contacts 13. Meanwhile, to the elastic member body-accommodating portions 13C of the two contacts 13 constituting the second row R2, the corresponding flexible conductors 21 extend from the +X direction side in the −X direction, and the contact portions 21A provided at the −X directional ends of the flexible conductors 21 are situated on the elastic member body-accommodating portions 13C of the contacts 13.

Figure 12:
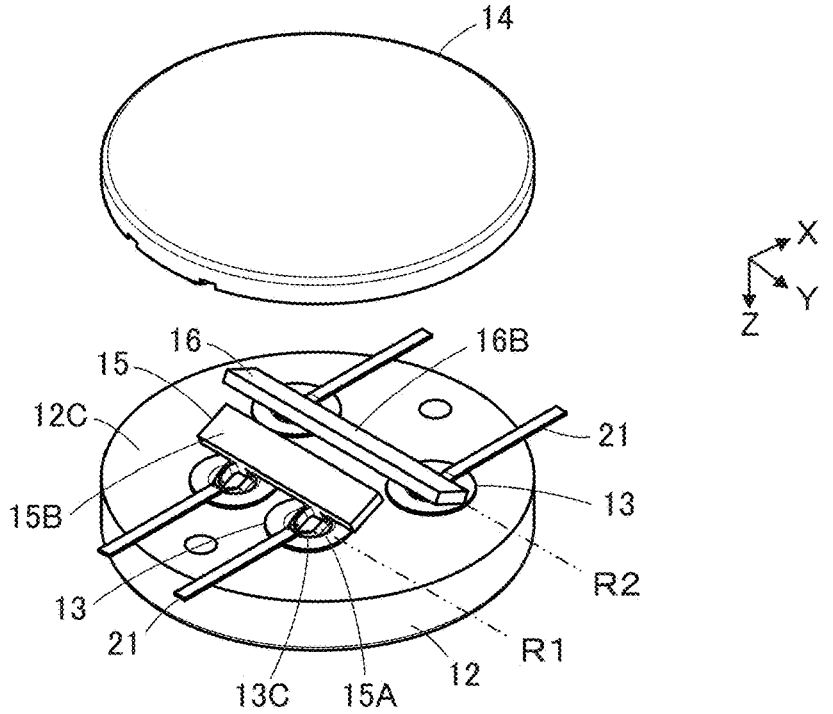
FIG. 12 is an assembly view of the connector when the elastic members are obliquely disposed with respect to the contacts.

In this state, as illustrated in FIG. 12, the two elastic member bodies 15A of the elastic member 15 are obliquely inserted into the elastic member body-accommodating portions 13C of the two contacts 13 constituting the first row R1, while the two elastic member bodies 16A of the elastic member 16 are obliquely inserted into the elastic member body-accommodating portions 13C of the two contacts 13 constituting the second row R2.

Figure 13:
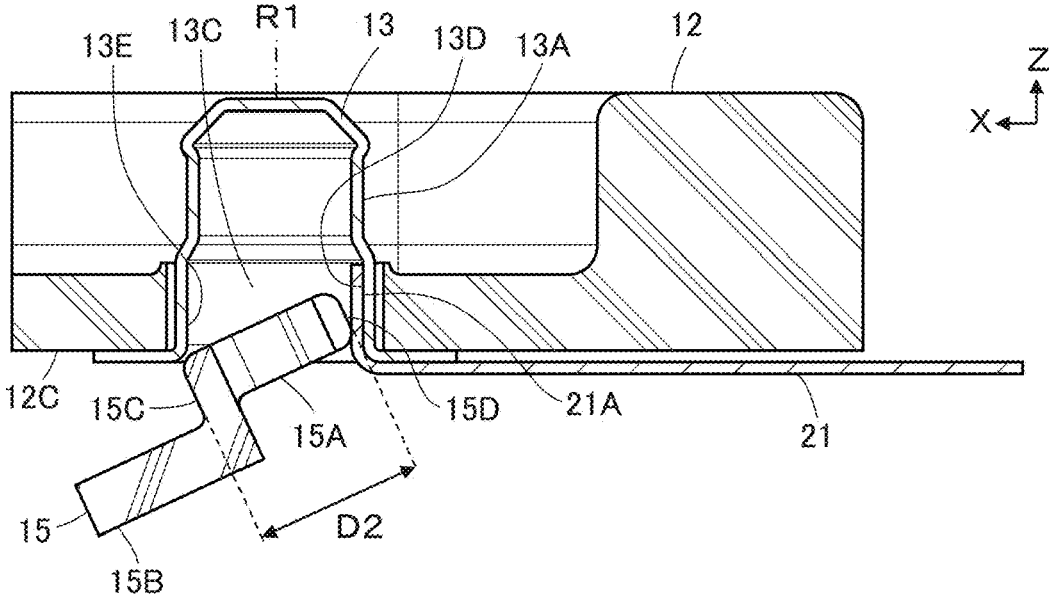
FIG. 13 is a partial cross-sectional view showing the elastic member disposed obliquely to the contact.

As a result, as illustrated in FIG. 13, of each elastic member body 15A of the elastic member 15, only the pressing portion 15D is inserted into the elastic member body-accommodating portion 13C of the corresponding contact 13 arranged in the first row R1, the base portion 15C protrudes on the −Z direction side of the elastic member body-accommodating portion 13C, and the rotation operating portion 15B joined to the base portion 15C obliquely projects from the surface 12C of the first insulator 12 on the −Z direction side. Accordingly, the pressing portion 15D is not elastically displaced with respect to the base portion 15C, and the external dimension D2 of the elastic member body 15A is maintained.

In addition, the contact portion 21A of the flexible conductor 21 disposed on the elastic member body-accommodating portion 13C of the contact 13 is pushed by the pressing portion 15D of the elastic member body 15A to bend in the +Z direction and is inserted into the elastic member body-accommodating portion 13C of the contact 13. The contact portion 21A of the flexible conductor 21 comes into contact with the pressing portion 15D of the elastic member body 15A and is disposed to be sandwiched between the pressing portion 15D of the elastic member body 15A and the conductor-contact portion 13D of the elastic member body-accommodating portion 13C. At this time, the contact portion 21A of the flexible conductor 21 is pushed in the +Z direction by the pressing portion 15D of the elastic member body 15A of the elastic member 15 and inserted into the elastic member body-accommodating portion 13C of the contact 13, while bending in the +Z direction without being rubbed by the pressing portion 15D.

Although not illustrated, similarly, of each elastic member body 16A of the elastic member 16, only the pressing portion 16D is inserted into the elastic member body-accommodating portion 13C of the corresponding contact 13 arranged in the second row R2, the base portion 16C protrudes on the −Z direction side of the elastic member body-accommodating portion 13C, and the rotation operating portion 16B joined to the base portion 16C obliquely projects from the surface 12C of the first insulator 12 on the −Z direction side. Accordingly, the pressing portion 16D is not elastically displaced, and the external dimension D2 of the elastic member body 16A is maintained.

In addition, the contact portion 21A of the flexible conductor 21 disposed on the elastic member body-accommodating portion 13C of the contact 13 bends in the +Z direction, is inserted into the elastic member body-accommodating portion 13C of the contact 13 and is disposed to be sandwiched between the pressing portion 16D of the elastic member body 16A and the conductor-contact portion 13D of the elastic member body-accommodating portion 13C. At this time, the contact portion 21A of the flexible conductor 21 is pushed in the +Z direction by the pressing portion 16D of the elastic member body 16A of the elastic member 16 and inserted into the elastic member body-accommodating portion 13C of the contact 13, while bending in the +Z direction without being rubbed by the pressing portion 16D.

Figure 14:
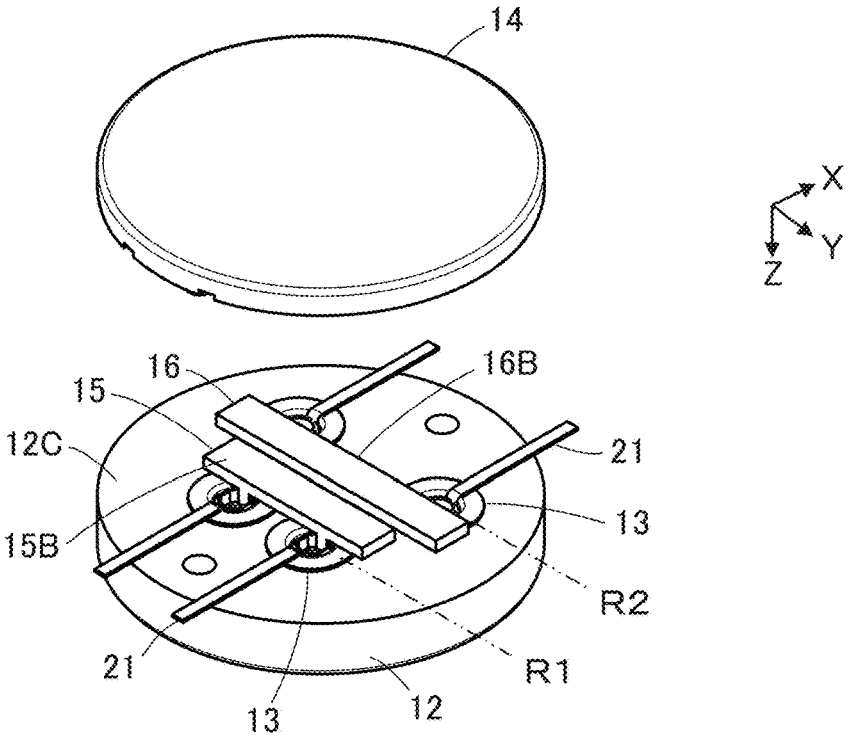
FIG. 14 is an assembly view of the connector when elastic member bodies are accommodated in elastic member body-accommodating portions of the contacts.

Next, by operating the rotation operating portions 15B and 16B obliquely projecting from the surface 12C of the first insulator 12 on the −Z direction side, the elastic members 15 and 16 are rotated until the rotation operating portions 15B and 16B become parallel to the surface 12C of the first insulator 12, as illustrated in FIG. 14.

Figure 15:
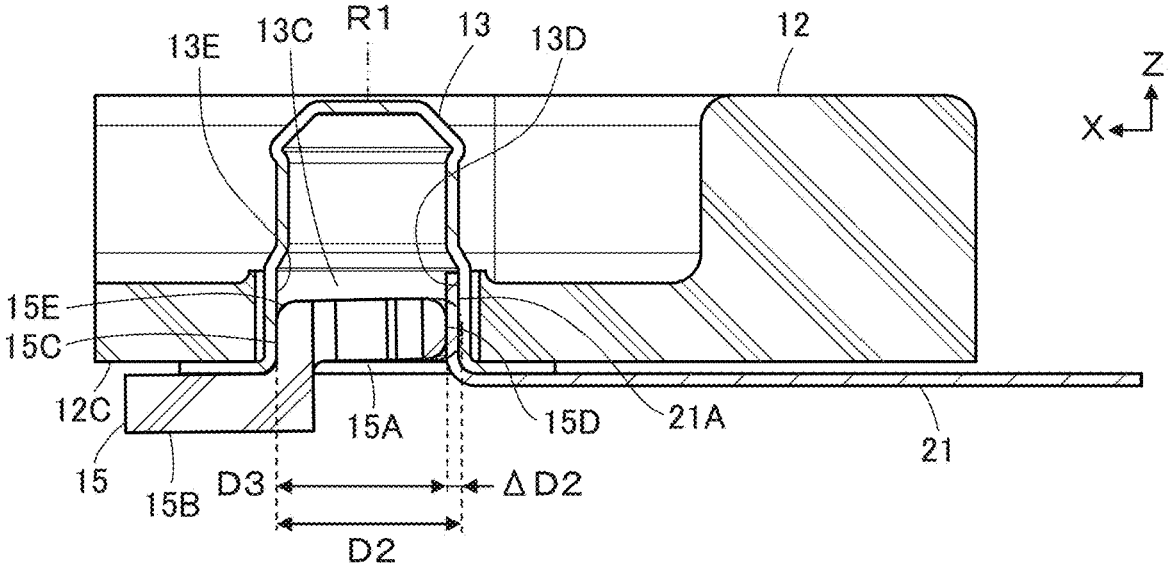
FIG. 15 is a partial cross-sectional view showing the elastic member body accommodated in the elastic member body-accommodating portion of the contact.

As illustrated in FIG. 15, the elastic member 15 is rotated about the pressing portion 15D which is in contact with the contact portion 21A of the flexible conductor 21 inserted into the elastic member body-accommodating portion 13C of the contact 13 arranged in the first row R1. Meanwhile, since the curved surface 15E is provided at an edge of the elastic member body 15A situated at the +Z directional end of the base portion 15C, the pressing portion 15D is elastically displaced as the elastic member 15 is rotated, and the base portion 15C of the elastic member body 15A is inserted into the elastic member body-accommodating portion 13C of the contact 13.

When the elastic member 15 is rotated until the rotation operating portion 15B becomes parallel to the surface 12C of the first insulator 12 in this manner, the base portion 15C of the elastic member body 15A comes into contact with the elastic member-contact portion 13E of the elastic member body-accommodating portion 13C of the contact 13, and the pressing portion 15D that has been elastically displaced presses the contact portion 21A of the flexible conductor 21 against the conductor-contact portion 13D of the elastic member body-accommodating portion 13C of the contact 13. As a result, each contact 13 arranged in the first row R1 is electrically connected to the corresponding flexible conductor 21.

In this process, the pressing portion 15D of the elastic member body 15A is elastically displaced in the +X direction by a displacement amount of ΔD2, whereby the external dimension of the elastic member body 15A in the X direction turns to be an external dimension D3 that is equal to a value obtained by subtracting the thickness of the flexible conductor 21 from the inside diameter D1 of the elastic member body-accommodating portion 13C of the contact 13.

Although not illustrated, similarly, the elastic member 16 is rotated about the pressing portion 16D which is in contact with the contact portion 21A of the flexible conductor 21 inserted into the elastic member body-accommodating portion 13C of the contact 13 arranged in the second row R2, and while the pressing portion 16D is elastically displaced, the base portion 16C of the elastic member body 16A is inserted into the elastic member body-accommodating portion 13C of the contact 13.

When the elastic member 16 is rotated until the rotation operating portion 16B becomes parallel to the surface 12C of the first insulator 12, the base portion 16C of the elastic member body 16A comes into contact with the elastic member-contact portion 13E of the elastic member body-accommodating portion 13C of the contact 13, and the pressing portion 16D that has been elastically displaced presses the contact portion 21A of the flexible conductor 21 against the conductor-contact portion 13D of the elastic member body-accommodating portion 13C of the contact 13. As a result, each contact 13 arranged in the second row R2 is electrically connected to the corresponding flexible conductor 21.

Even when the elastic members 15 and 16 are separately rotated through operations of the rotation operating portions 15B and 16B, the elastic members 15 and 16 respectively rotate about the pressing portions 15D and 16D which are in contact with the contact portions 21A of the flexible conductors 21 inserted into the elastic member body-accommodating portions 13C of the corresponding contacts 13, and therefore the contact portions 21A of the flexible conductors 21 would not be rubbed by the pressing portions 15D and 16D.

Subsequently, the two fixing posts 14F of the second insulator 14 are inserted into the two post accommodating portions 12D of the first insulator 12, and the first insulator 12 and the second insulator 14 are adhered to each other with an adhesive, with the flexible conductors 21 being sandwiched therebetween, such that the surface 12C, on the −Z direction side, of the first insulator 12 and the surface 14, facing in the +Z direction, of the flat plate portion 14A of the second insulator 14 oppose each other, whereby connection of the connector 11 to the flexible conductors 21 is completed.

Figure 16:
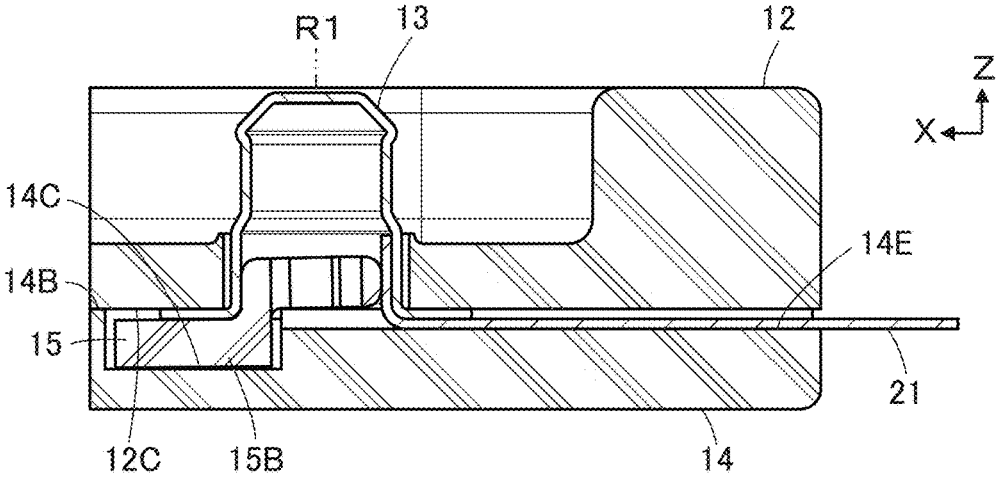
FIG. 16 is a partial cross-sectional view showing the connector according to Embodiment 1.

At this time, as illustrated in FIG. 16, the rotation operating portion 15B of the elastic member 15 is accommodated in the elastic member-corresponding recess 14C formed in the second insulator 14, and the flexible conductor 21 connected to the contact 13 arranged in the first row R1 is accommodated in the conductor accommodating groove 14E formed in the second insulator 14 so as to be communicated with the elastic member-corresponding recess 14C.

Although not illustrated, similarly, the rotation operating portion 16B of the elastic member 16 is accommodated in the elastic member-corresponding recess 14D formed in the second insulator 14, and the flexible conductor 21 connected to the contact 13 arranged in the second row R2 is accommodated in the conductor accommodating groove 14E formed in the second insulator 14 so as to be communicated with the elastic member-corresponding recess 14C.

Here, both when the elastic members 15 and 16 are obliquely disposed with respect to the contacts 13 and when the elastic members 15 and 16 are rotated through operations of the rotation operating portions 15B and 16B, the contact portions 21A of the flexible conductors 21 are not rubbed by the pressing portions 15D and 16D, and the flexible conductors 21 are hence prevented from being damaged, whereby reliability of electrical connection between the flexible conductors 21 and the contacts 13 can be ensured.

Figure 17:
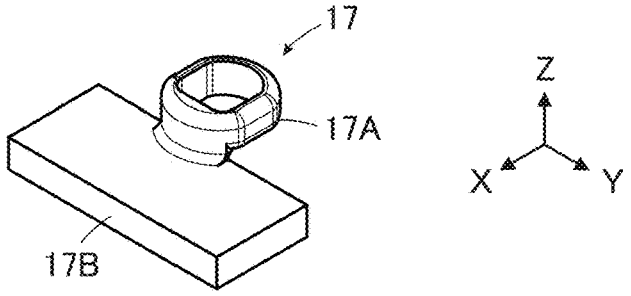
FIG. 17 is a perspective view showing an elastic member used in a connector according to a variation of Embodiment 1.

In Embodiment 1 described above, the elastic member 15 includes two elastic member bodies 15A to correspond to the two contacts 13 constituting the first row R1, and the elastic member 16 includes two elastic member bodies 16A to correspond to the two contacts 13 constituting the second row R2. However, this is not the sole case, and as shown in FIG. 17, an elastic member 17 corresponding to a single contact 13 may also be used.

The elastic member 17 includes a single elastic member body 17A and a single rotation operating portion 17B joined to the elastic member body 17A. The elastic member body 17A has the same configuration as that of the elastic member body 15A of the elastic member 15 and that of the elastic member body 16A of the elastic member 16, and the rotation operating portion 17B also has the same configuration as that of the rotation operating portion 15B of the elastic member 15 and that of the rotation operating portion 16B of the elastic member 16.

With use of four elastic members 17, the connector 11 can be similarly connected to a plurality of flexible conductors 21.

Meanwhile, when the elastic members 15 and 16 respectively including the two elastic member bodies 15A and the two elastic member bodies 16A are used, two contacts 13 can be connected to two flexible conductors 21 at a time through a single operation of the rotation operating portions 15B and 16B, thereby enabling efficient connection of the connector 11 to a plurality of flexible conductors 21.

In Embodiment 1 described above, the connector 11 includes four contacts 13, but this is not the sole case. The present invention can be applied to a connector having one or more contacts 13.

When a connector includes three or more contacts 13 that are aligned in a straight line, an elastic member in which three or more elastic member bodies corresponding to the three or more contacts 13 are joined to a single rotation operating portion can be used.

Figure 18:
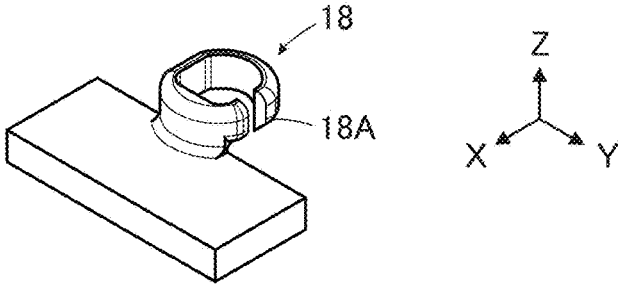
FIG. 18 is a perspective view showing an elastic member used in a connector according to another variation of Embodiment 1.
Figure 19:
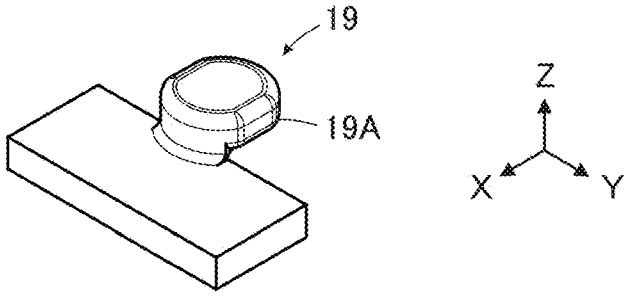
FIG. 19 is a perspective view showing an elastic member used in a connector according to yet another variation of Embodiment 1.

In Embodiment 1 described above, the elastic member bodies 15A and 16A of the elastic members 15 and 16 have a ring-like shape. Meanwhile, it is only required that the pressing portions 15D and 16D are elastically displaceable in the X direction, and the use may be made of, for instance, an elastic member 18 including an elastic member body 18A having a C shape as illustrated in FIG. 18, or an elastic member 19 including an elastic member body 19A having a flat plate shape as illustrated in FIG. 19.

Moreover, in Embodiment 1 described above, the flexible conductor 21 is not supported by, for instance, an insulating substrate body but is independently disposed between the pressing portion 15D or 16D of the elastic member 15 or 16 and the conductor-contact portion 13D of the contact 13, but this is not the sole case. The connector of the present invention can be connected to the flexible conductor 21 disposed to be exposed on a front surface of a substrate body made of an insulating material. Meanwhile, in order to electrically connect the contact 13 to the flexible conductor 21, it is required to dispose the flexible conductor 21 such that the flexible conductor 21 faces the conductor-contact portion 13D of the contact 13 and that a rear surface of the substrate body made of an insulating material faces the pressing portion 15D or 16D of the elastic member 15 or 16.

Embodiment 2

Figure 20:
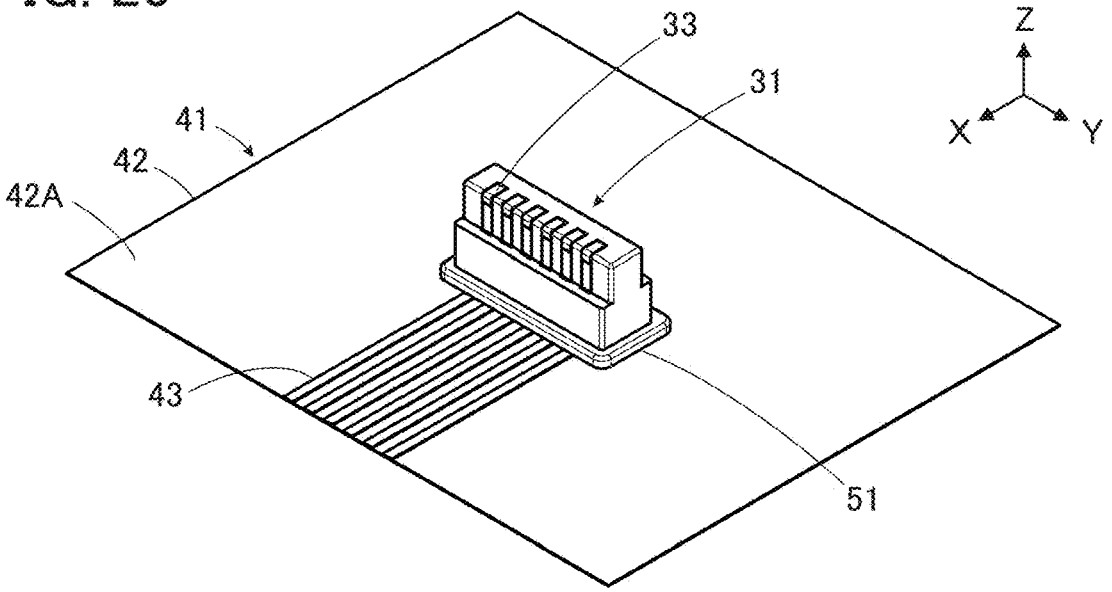
FIG. 20 is a perspective view of a connector according to Embodiment 2 when viewed from an obliquely upper position.
Figure 21:
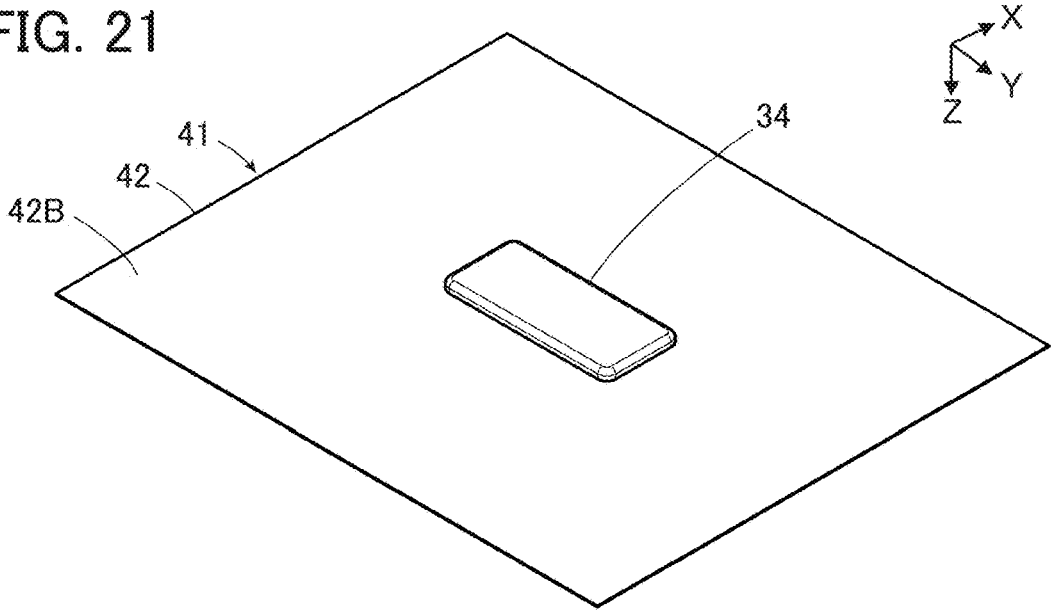
FIG. 21 is a perspective view of the connector according to Embodiment 2 when viewed from an obliquely lower position.
Figure 22:
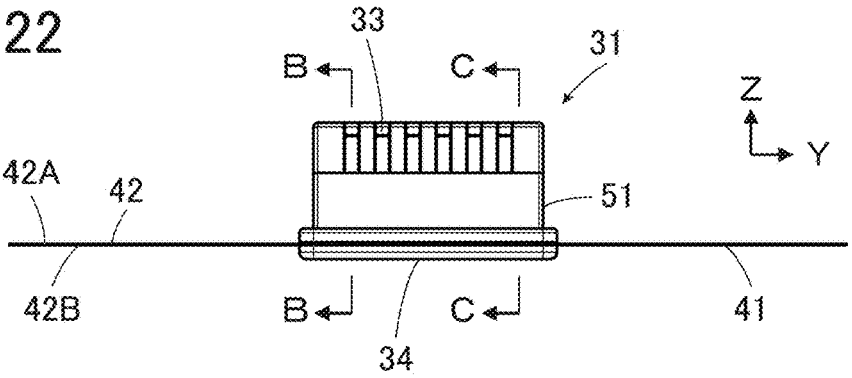
FIG. 22 is a front view of the connector according to Embodiment 2.

FIGS. 20 to 22 illustrate a connector 31 according to Embodiment 2. As with the connector 11 of Embodiment 1, the connector 31 is used as, for example, a garment-side connector portion for fitting a wearable device, and is mounted on a flexible substrate 41.

The connector 31 includes a contact unit 51 disposed on a surface of the flexible substrate 41 and having a plurality of contacts 33, and a second insulator 34 that faces the contact unit 51 with the flexible substrate 41 being sandwiched therebetween.

The flexible substrate 41 includes a sheet-like substrate body 42 made of an insulating material, the substrate body 42 has a front surface 42A facing in the +Z direction and a rear surface 42B facing in the −Z direction. A plurality of flexible conductors 43 are disposed to be exposed on the front surface 42A of the substrate body 42. The plurality of flexible conductors 43 are, for instance, band-like or yarn-like conductors formed of conductive fibers, extend in the X direction and are arranged in parallel to each other in the Y direction.

The flexible conductors 43 may be made of conductive paste applied onto the front surface 42A of the substrate body 42 by printing or another method.

The contact unit 51 constitutes a contact member in Embodiment 2 and is disposed on and projects from the front surface 42A of the substrate body 42 of the flexible substrate 41.

For convenience, the front surface 42A of the substrate body 42 of the flexible substrate 41 is defined as extending along an XY plane, and the direction in which the contact unit 51 projects is referred to as "+Z direction."

Figure 23:
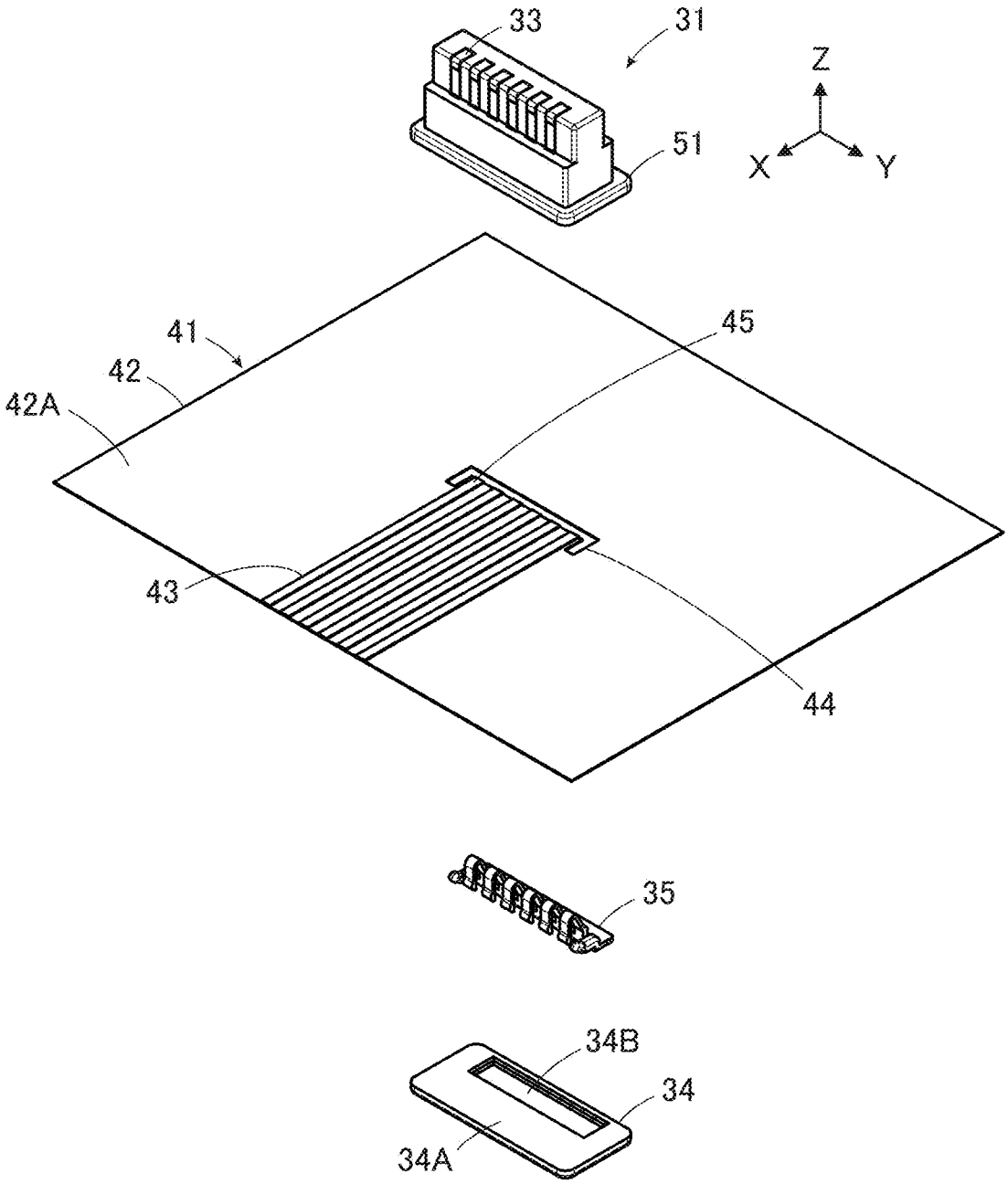
FIG. 23 is an assembly view of the connector according to Embodiment 2 when viewed from an obliquely upper position.
Figure 24:
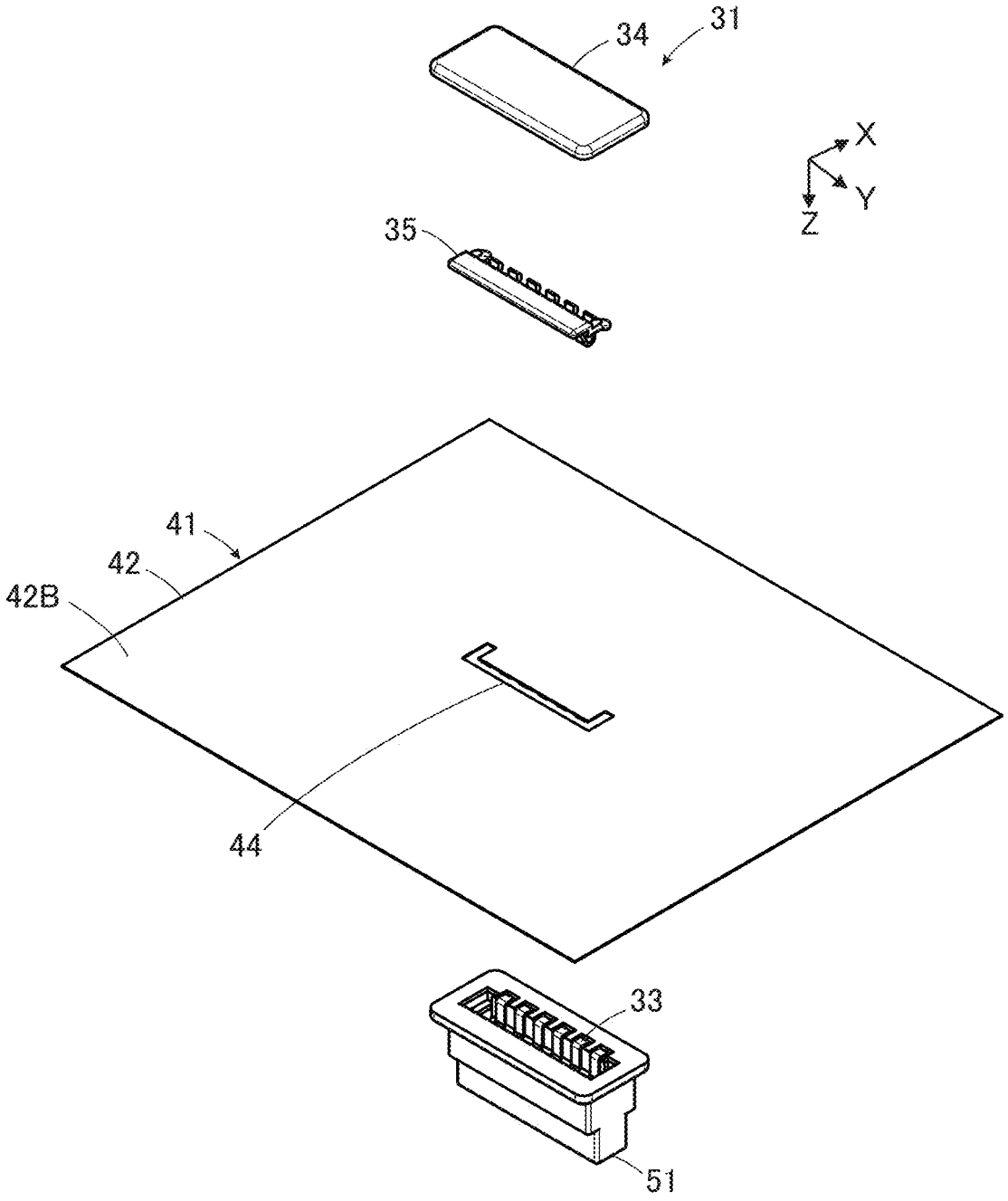
FIG. 24 is an assembly view of the connector according to Embodiment 2 when viewed from an obliquely lower position.

FIGS. 23 and 24 illustrate assembly views of the connector 31. The flexible substrate 41 is disposed on the −Z direction side of the contact unit 51. The flexible substrate 41 is provided with a cut 44. The cut 44 has a substantially U shape extending linearly in the Y direction and slightly extending in the +X direction from each of the +Y and −Y directional ends thereof. On the front surface 42A of the substrate body 42, the plurality of flexible conductors 43 are disposed in parallel to each other on the +X direction side of the cut 44. The −X directional end of each flexible conductor 43 reaches the cut 44 and forms a contact portion 45 that is bendable.

An elastic member 35 is disposed on the −Z direction side of the flexible substrate 41, and a second insulator 34 is disposed on the −Z direction side of the elastic member 35.

The elastic member 35 is used to electrically connect the contact portions 45 of the flexible conductors 43 to the corresponding contacts 33 of the contact unit 51.

The second insulator 34 is made of an insulating resin and has a flat plate shape, and an elastic member-corresponding recess 34B is formed in a surface 34A of the second insulator 34, which surface 34A faces in the +Z direction.

Figure 25:
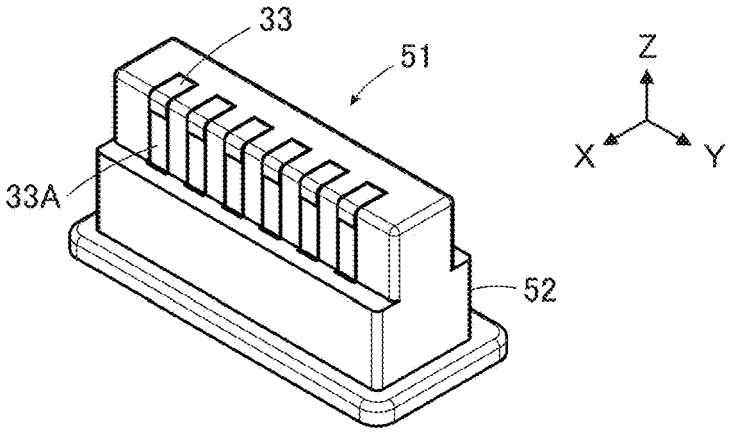
FIG. 25 is a perspective view of a contact unit used in the connector according to Embodiment 2 when viewed from an obliquely upper position.
Figure 26:
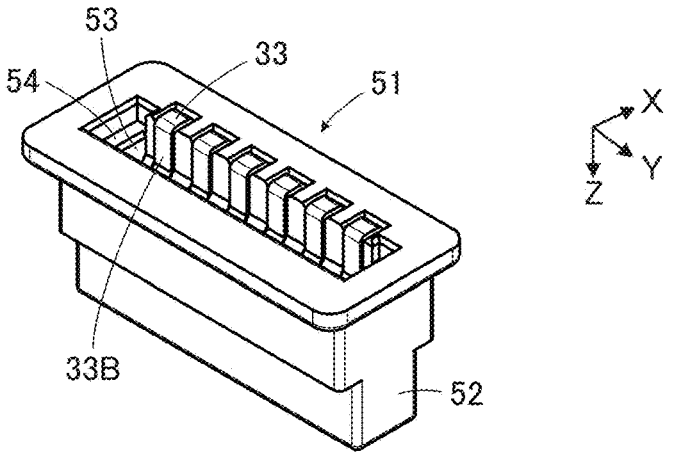
FIG. 26 is a perspective view of the contact unit used in the connector according to Embodiment 2 when viewed from an obliquely lower position.

As illustrated in FIGS. 25 and 26, the contact unit 51 is configured such that the plurality of contacts 33 aligned in the Y direction are held by a contact-insulator 52.

Figure 27:
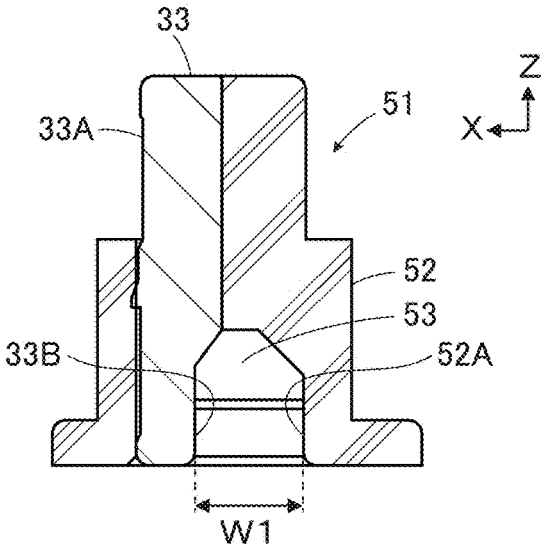
FIG. 27 is a cross-sectional view showing the contact unit used in the connector according to Embodiment 2.

Each of the contacts 33 is a plug-type contact formed of a conductive material such as metal, is to be connected to a corresponding contact of a counter-connector that is not shown, and has a flat plate shape extending in the Z direction as illustrated in FIG. 27. More specifically, the contact 33 includes a contact portion 33A formed at the +X directional edge face on the +Z directional end side, and a conductor-contact portion 33B formed at the −X directional edge face on the −Z directional end side.

The contacts 33 are held by the contact-insulator 52 with the contact portions 33A and the conductor-contact portions 33B being exposed.

The contact-insulator 52 includes an elastic member-contact portion 52A extending along a YZ plane to face the conductor-contact portions 33B of the contacts 33, and an elastic member body-accommodating portion 53 of recess shape extending in the Y direction and opening toward the −Z direction is formed between the conductor-contact portions 33B of the contacts 33 and the elastic member-contact portion 52A of the contact-insulator 52 facing each other. The elastic member body-accommodating portion 53 has a width W1 in the X direction at the −Z directional end.

As illustrated in FIG. 26, in the contact-insulator 52, a pair of recess-shaped guide receiving portions 54 are formed separately on the +Y direction side further from the +Y directional end of the elastic member body-accommodating portion 53 and on the −Y direction side further from the −Y directional end of the elastic member body-accommodating portion 53.

Figure 28:
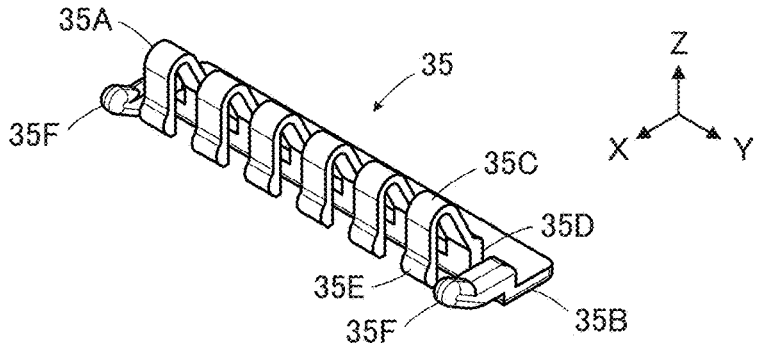
FIG. 28 is a perspective view of an elastic member used in the connector according to Embodiment 2 when viewed from an obliquely upper position.
Figure 29:
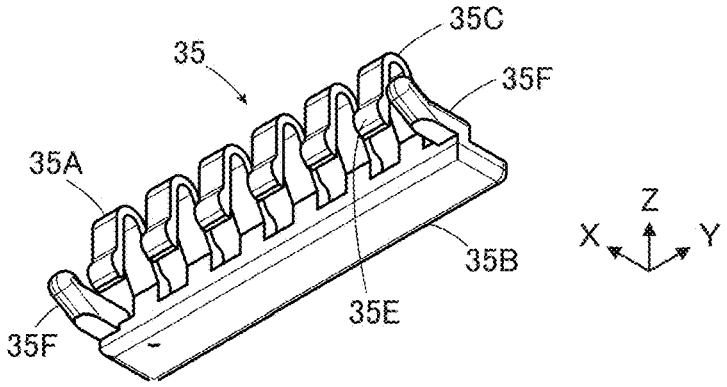
FIG. 29 is a perspective view of the elastic member used in the connector according to Embodiment 2 when viewed from an obliquely lower position.
Figure 30:
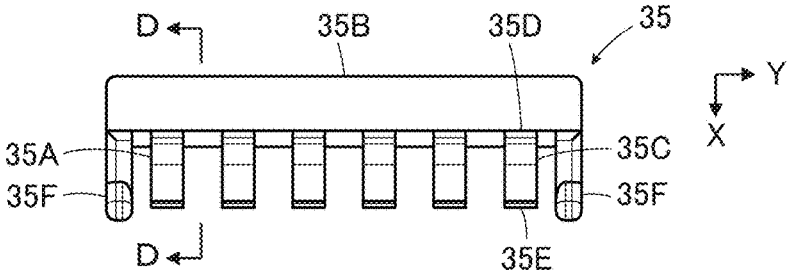
FIG. 30 is a plan view showing the elastic member used in the connector according to Embodiment 2.

The elastic member 35 is formed of an elastically deformable resin or metal and includes an elastic member body 35A and a rotation operating portion 356 joined to the elastic member body 35A as illustrated in FIGS. 28 to 30.

The elastic member body 35A includes a plurality of elastic pieces 35C of cantilever shape that are joined to the rotation operating portion 35B and are aligned in the Y direction. Each elastic piece 35C is provided, at its base end part, with a base portion 35D joined to the rotation operating portion 35B; the elastic piece 35 is shaped to rise from the base portion 35D toward the +Z direction and the +X direction and bend in the −Z direction as curving at the apex of the rising.

The elastic piece 35C is provided, at its tip end part forming a free end of a cantilever, with a pressing portion 35E that is elastically displaceable in the X direction (predetermined direction) with respect to the base portion 35D and that projects in the +X direction.

The pressing portion 35E presses the contact portion 45 of the flexible conductor 43 against the conductor-contact portion 33B of the corresponding contact 33 of the contact unit 51 to electrically connect the flexible conductor 43 to the contact 33.

The rotation operating portion 35B is joined to the base portions 35D of the plurality of elastic pieces 35C of the elastic member body 35A and has a flat plate shape extending in the Y direction and in the −X direction, i.e., on the opposite side to the pressing portions 35E of the elastic pieces 35C. The rotation operating portion 35B is used to rotate the plurality of elastic pieces 35C about a Y axis at a time.

A pair of guide portions 35F projecting in the +X direction are separately joined to the −Y directional end and the +Y directional end of the rotation operating portion 35B. The elastic pieces 35C aligned in the Y direction are disposed between the pair of guide portions 35F.

Figure 31:
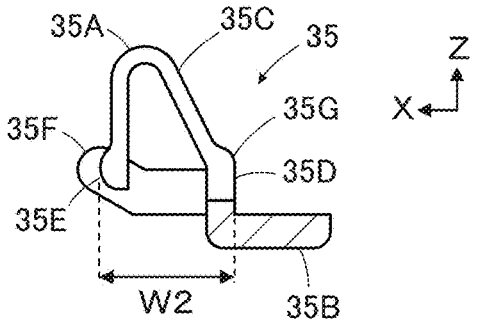
FIG. 31 is a cross-sectional view taken along line D-D in FIG. 30.

As illustrated in FIG. 31, each elastic piece 35C has a width W2 in the X direction from the base portion 35D to the pressing portion 35E. The width W2 of the elastic piece 35C in the X direction is set to be larger than a value obtained by subtracting a thickness of the flexible conductor 43 from the width W1 in the X direction of the elastic member body-accommodating portion 53 formed in the contact unit 51.

In addition, a curved surface 35G is formed at the +Z directional end of the base portion 35D of the elastic piece 35C.

The elastic member body 35A is to be accommodated in the elastic member body-accommodating portion 53 of the contact unit 51 and has a Y directional length slightly shorter than a Y directional length of the elastic member body-accommodating portion 53 of the contact unit 51.

The pair of guide portions 35F of the elastic member 35 have a size and an interval therebetween corresponding to the pair of recess-shaped guide receiving portions 54 of the contact unit 51, and the substantially U-shaped cut 44 of the flexible substrate 41 also has a size corresponding to the pair of guide portions 35F of the elastic member 35 and the pair of recess-shaped guide receiving portions 54 of the contact unit 51.

In addition, the plurality of elastic pieces 35C have a height dimension in the Z direction smaller than a depth dimension in the Z direction of the elastic member body-accommodating portion 53 so as not to abut a ceiling portion of the elastic member body-accommodating portion 53 when the elastic member body 35A is accommodated in the elastic member body-accommodating portion 53 of the contact unit 51.

Figure 32:
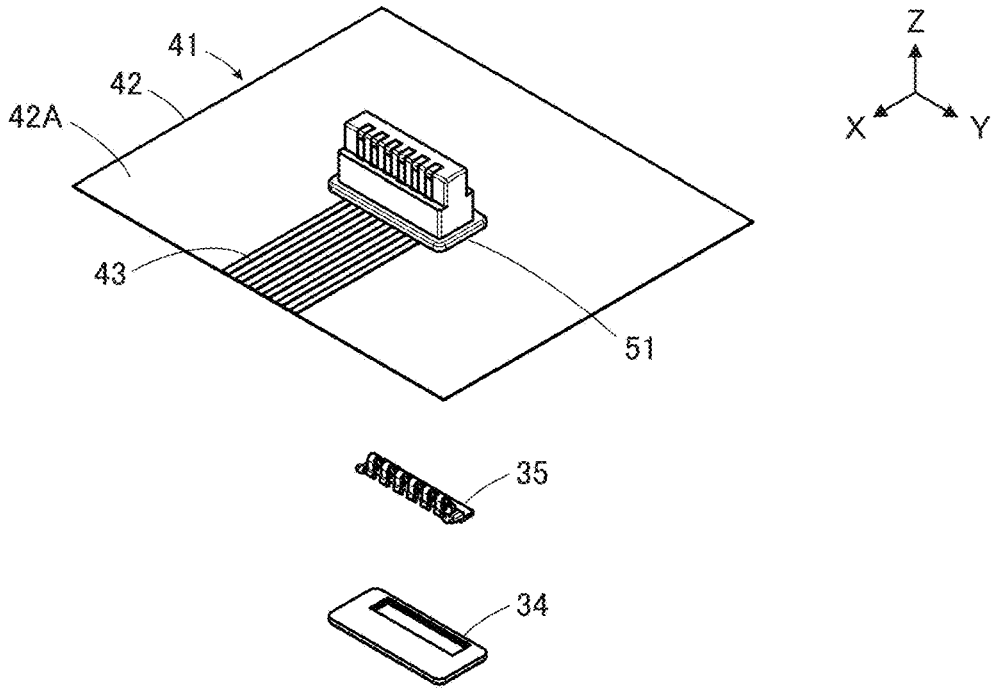
FIG. 32 is an assembly view of the connector with the contact unit being disposed on a flexible substrate when viewed from an obliquely upper position.

For mounting the connector 31 on the flexible substrate 41, first, as illustrated in FIG. 32, the contact unit 51 is disposed on the front surface 42A of the substrate body 42 of the flexible substrate 41. At this time, the contact unit 51 is disposed on the plurality of flexible conductors 43 immediately above the cut 44 of the flexible substrate 41.

Figure 33:
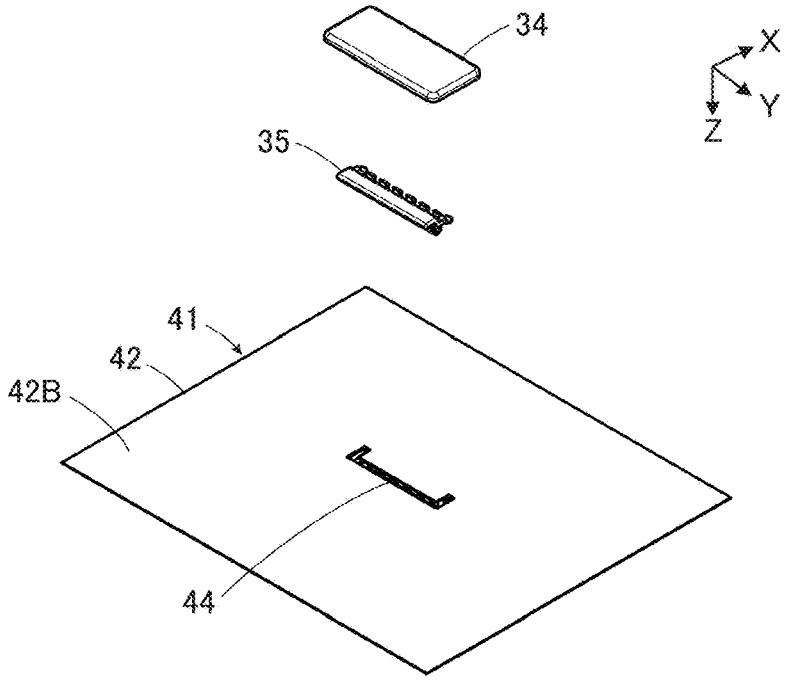
FIG. 33 is an assembly view of the connector with the contact unit being disposed on the flexible substrate when viewed from an obliquely lower position.
Figure 34:
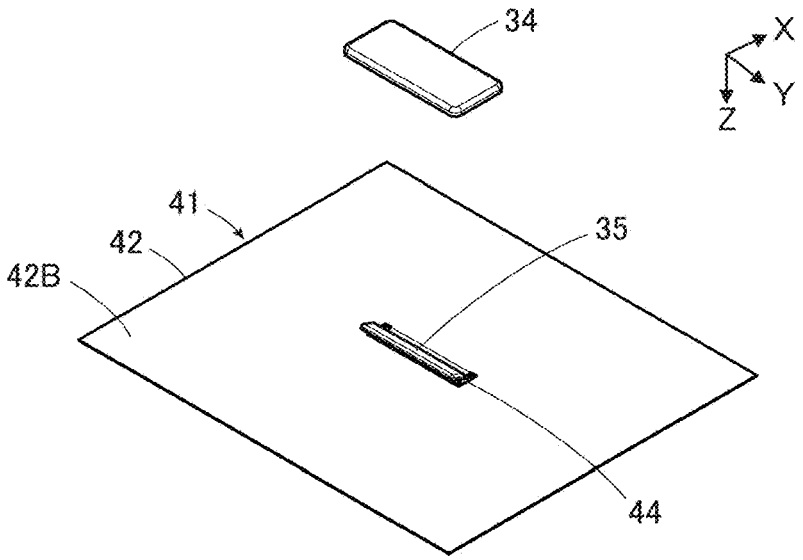
FIG. 34 is an assembly view of the connector with the elastic member being obliquely disposed with respect to the contact unit.

Then, as illustrated in FIG. 33, the elastic member 35 is moved from the −Z direction toward the cut 44 in the rear surface 42B of the substrate body 42 of the flexible substrate 41, and as illustrated in FIG. 34, the elastic member 35 is obliquely inserted into the elastic member body-accommodating portion 53 of the contact unit 51 through the cut 44.

Figure 35:
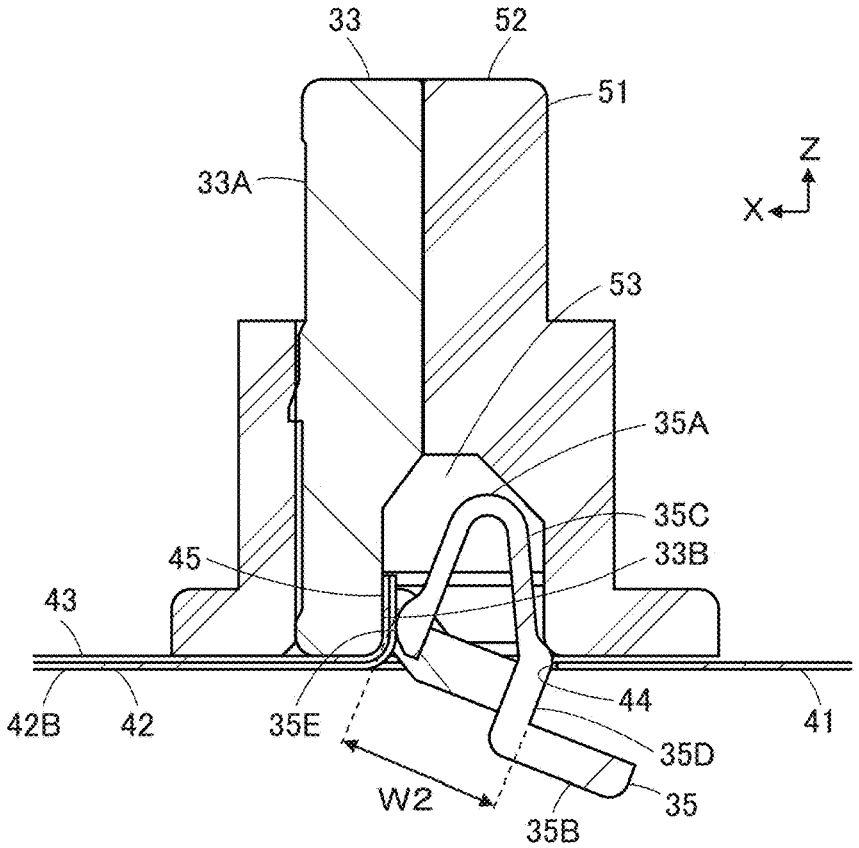
FIG. 35 is a cross-sectional view showing a positional relationship between an elastic member body and an elastic member body-accommodating portion when the elastic member is obliquely disposed with respect to the contact unit.

As a result, as illustrated in FIG. 35, of the elastic member body 35A of the elastic member 35, the pressing portions 35E of the plurality of elastic pieces 35C are inserted in the elastic member body-accommodating portion 53 of the contact unit 51, while the base portions 35D of the elastic pieces 35C protrude on the −Z direction side of the elastic member body-accommodating portion 53, and the rotation operating portion 35B joined to the base portions 35D obliquely projects on the −Z direction side from the rear surface 42B of the substrate body 42 of the flexible substrate 41. Accordingly, the pressing portion 35E of each elastic piece 35C is not elastically displaced with respect to the base portion 35D, and hence the width W2 of the elastic piece 35C is maintained.

Further, the contact portions 45 of the plurality of flexible conductors 43 disposed on the +X direction side of the cut 44 of the flexible substrate 41 are pushed by the elastic pieces 35C of the elastic member body 35A to bend in the +Z direction and are inserted into the elastic member body-accommodating portion 53 of the contact unit 51. The contact portions 45 of the flexible conductors 43 come into contact with the pressing portions 35E of the elastic pieces 35C of the elastic member body 35A and are disposed to be sandwiched between the pressing portions 35E of the plurality of elastic pieces 35C and the conductor-contact portions 33B of the plurality of contacts 33 of the contact unit 51. At this time, the contact portions 45 of the flexible conductors 43 are pushed in the +Z direction by the pressing portions 35E of the corresponding elastic pieces 35C of the elastic member 35 and are inserted into the elastic member body-accommodating portion 53 of the contact unit 51; the contact portions 45 bend in the +Z direction without being rubbed by the pressing portions 35E.

Figure 36:
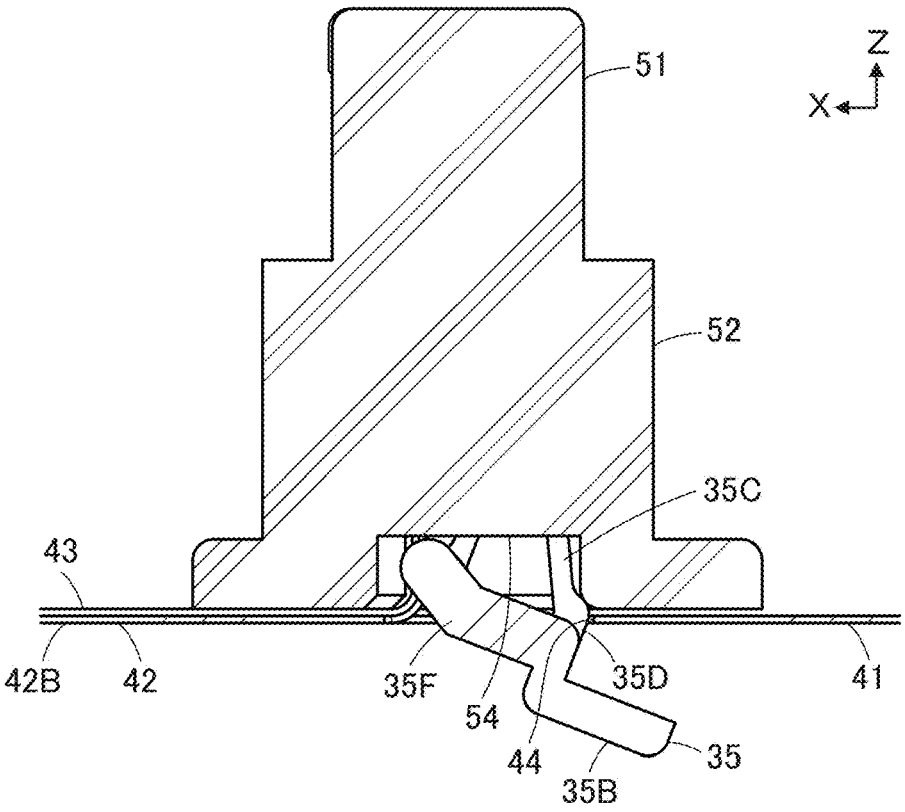
FIG. 36 is a cross-sectional view showing a positional relationship between a guide portion and a guide receiving portion when the elastic member is obliquely disposed with respect to the contact unit.

At this time, as illustrated in FIG. 36, while the +X directional ends of the pair of guide portions 35F of the elastic member 35 are inserted into the pair of recess-shaped guide receiving portions 54 of the contact unit 51 through the cut 44, the −X directional ends of the pair of guide portions 35F protrude on the −Z direction side of the pair of recess-shaped guide receiving portions 54.

Figure 37:
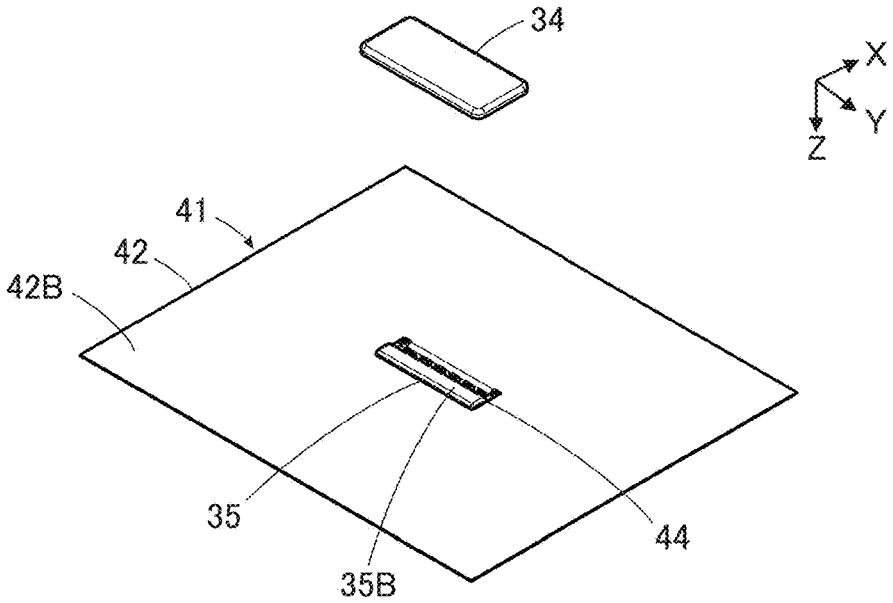
FIG. 37 is an assembly view of the connector when the elastic member body is accommodated in the elastic member body-accommodating portion of the contact unit.

Subsequently, the rotation operating portion 35B obliquely projecting on the −Z direction side from the rear surface 42B of the substrate body 42 of the flexible substrate 41 is operated to rotate the elastic member 35 until the rotation operating portion 35B becomes parallel to the rear surface 42B of the substrate body 42 of the flexible substrate 41 as illustrated in FIG. 37.

Figure 38:
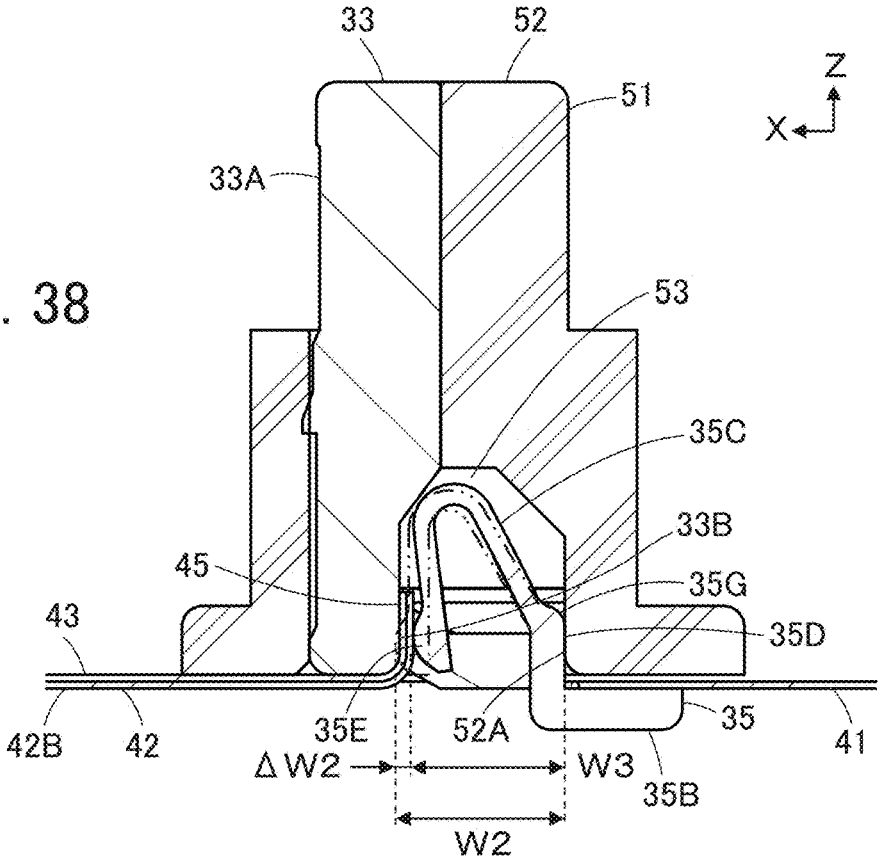
FIG. 38 is a cross-sectional view showing the elastic member body accommodated in the elastic member body-accommodating portion of the contact unit.

As illustrated in FIG. 38, the elastic member 35 is rotated about the pressing portions 35E of the elastic pieces 35C, which pressing portions 35E are in contact with the contact portions 45 of the flexible conductors 43 inserted in the elastic member body-accommodating portion 53 of the contact unit 51. In the meantime, since the curved surface 35G is formed at the +Z directional end of the base portion 35D of each of the elastic pieces 35C, the base portions 35D of the elastic pieces 35C are inserted into the elastic member body-accommodating portion 53 of the contact unit 51 with the pressing portions 35E of the elastic pieces 35C being elastically displaced as the elastic member 35 is rotated.

When the elastic member 35 is rotated until the rotation operating portion 35B becomes parallel to the rear surface 42B of the substrate body 42 of the flexible substrate 41 in this manner, the base portions 35D of the elastic pieces 35C come into contact with the elastic member-contact portion 52A of the elastic member body-accommodating portion 53 of the contact unit 51, and the pressing portions 35E of the elastic pieces 35C that have been elastically displaced press the contact portions 45 of the flexible conductors 43 against the conductor-contact portions 33B of the contacts 33 of the contact unit 51. As a result, the plurality of contacts 33 are electrically connected to the plurality of flexible conductors 43.

At this time, of each elastic piece 35C of the elastic member body 35A, the pressing portion 35E is elastically displaced in the −X direction by a displacement amount $\Delta W2$, whereby the width of the elastic piece 35C in the X direction turns to be a width W3 that is equal to a value obtained by subtracting the thickness of the flexible conductor 43 from the width W1 in the X direction of the elastic member body-accommodating portion 53 formed in the contact unit 51.

When the elastic member 35 is rotated through the operation of the rotation operating portion 35B, the contact portion 45 of each of the flexible conductors 43 is also prevented from being rubbed by the pressing portion 35E of the corresponding elastic piece 35C since the elastic member 35 is rotated about the pressing portions 35E of the elastic pieces 35C, which pressing portions 35E are in contact with the contact portions 45 of the flexible conductors 43 inserted in the elastic member body-accommodating portion 53 of the contact unit 51.

Figure 39:
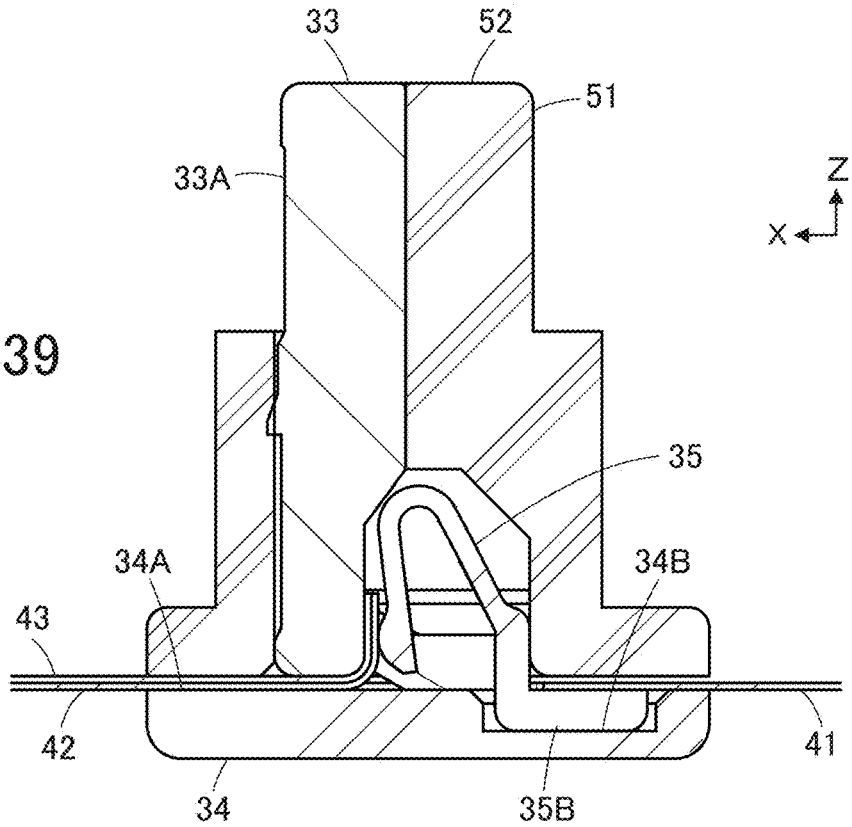
FIG. 39 is a cross-sectional view taken along line B-B in FIG. 22.

Thereafter, as illustrated in FIG. 39, the surface 34A of the second insulator 34, which surface 34A faces in the +Z direction, is adhered to the rear surface 42B of the substrate body 42 of the flexible substrate 41 with an adhesive. Meanwhile, the flexible substrate 41 and the contact unit 51 are also adhered to each other with an adhesive. Accordingly, the process of mounting the connector 31 on the flexible substrate 41 is completed.

In this process, the rotation operating portion 35B of the elastic member 35 is accommodated in the elastic member-corresponding recess 34B formed in the surface 34A of the second insulator 14.

Figure 40:
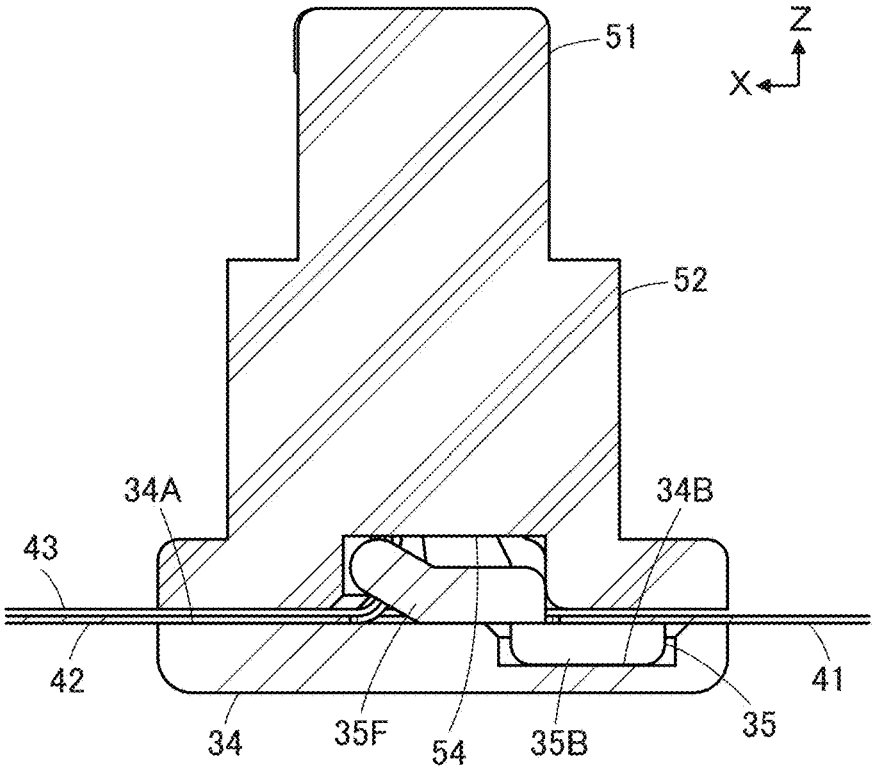
FIG. 40 is a cross-sectional view taken along line C-C in FIG. 22.
Figure 41:
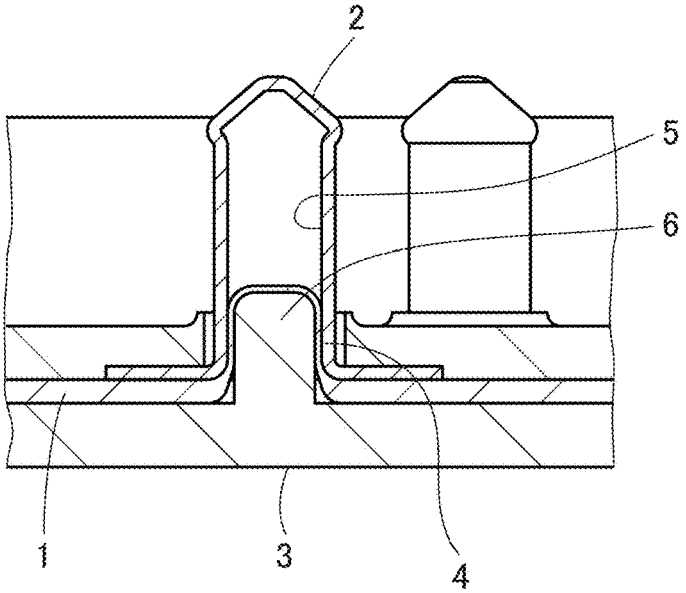
FIG. 41 PRIOR ART
FIG. 41 is a cross-sectional view showing a contact, a projection and a flexible substrate in a conventional connector.

In addition, as illustrated in FIG. 40, the pair of guide portions 35F of the elastic member 35 are accommodated in the pair of recess-shaped guide receiving portions 54 of the contact unit 51.

Both when the elastic member 35 is obliquely disposed with respect to the elastic member body-accommodating portion 53 of the contact unit 51 and when the elastic member 35 is rotated through the operation of the rotation operating portion 35B, the contact portions 45 of the flexible conductors 43 are not rubbed by the pressing portions 35E of the elastic pieces 35C of the elastic member 35, and accordingly, the flexible conductors 43 are prevented from being damaged, whereby reliability of electrical connection between the plurality of flexible conductors 43 and the plurality of contacts 33 of the contact unit 51 can be ensured.

In Embodiment 2, since the pair of guide portions 35F of the elastic member 35 are accommodated in the pair of recess-shaped guide receiving portions 54 of the contact unit 51 as illustrated in FIG. 40, the position of the elastic member body 35A of the elastic member 35 when accommodated in the elastic member body-accommodating portion 53 of the contact unit 51 is regulated. It is therefore possible to prevent damage to the elastic pieces 35C that may be caused if the elastic member body 35A of the elastic member 35 is inserted too far into the elastic member body-accommodating portion 53 of the contact unit 51, and the elastic pieces 35C abut the ceiling portion of the elastic member body-accommodating portion 53.

According to Embodiment 2, with use of the single elastic member 35, the plurality of contacts 33 of the contact unit 51 are electrically connected to the plurality of flexible conductors 43 of the flexible substrate 41, thereby enabling to realize a multi-core connector 31.

In Embodiment 2 described above, the plurality of contacts 33 of the contact unit 51 are aligned in one row, but this is not the sole case. For instance, the plurality of contacts 33 may be arranged in two rows, and with use of two elastic members 35, the contacts 33 in the respective rows may be electrically connected to the corresponding flexible conductors 43.

In Embodiment 2 described above, the connector 31 is mounted on the flexible substrate 41 in which the flexible conductors 43 are supported by the insulating substrate body 42, but this is not the sole case. It is also possible to configure a connector to be connected to the flexible conductors 43 that are not supported by an insulating substrate body but are independently disposed between the pressing portions 35E of the elastic pieces 35C of the elastic member 35 and the conductor-contact portions 33B of the contacts 33 of the contact unit 51.

While the plug-type contacts 13, 33 are used in the Embodiments 1 and 2 described above, this is not the sole case. It is also possible to similarly configure a connector in which receptacle-type contacts are connected to the flexible conductors 21, 43.

What is claimed is:

1. A connector to be connected to a flexible conductor, the connector comprising:

a contact member including a contact made of a conductive material; and an elastic member including an elastic member body and a rotation operating portion extending from the elastic member body, wherein the contact member includes a conductor-contact portion formed of part of the contact and an elastic member-contact portion disposed to be separated from the conductor-contact portion in a predetermined direction and facing the conductor-contact portion, wherein the elastic member body includes a base portion joined to the rotation operating portion and a pressing portion disposed to be separated from the base portion in the predetermined direction and being elastically displaceable in the predetermined direction with respect to the base portion, and wherein part of the flexible conductor is disposed between the pressing portion of the elastic member body and the conductor-contact portion of the contact member, the base portion of the elastic member body comes into contact with the elastic member-contact portion of the contact member, and the pressing portion elastically displaced in the predetermined direction presses the part of the flexible conductor against the conductor-contact portion, whereby the contact is electrically connected to the flexible conductor.

2. The connector according to claim 1, wherein the contact member is constituted by the contact, wherein the contact includes an elastic member body-accommodating portion of recess shape for accommodating the elastic member body, and wherein the conductor-contact portion is disposed at one end in the predetermined direction of the elastic member body-accommodating portion while the elastic member-contact portion is disposed at another end in the predetermined direction of the elastic member body-accommodating portion.

3. The connector according to claim 2, wherein the elastic member body has one of a ring shape, a C shape and a flat plate shape extending in a predetermined plane which includes the predetermined direction, and wherein the pressing portion is disposed at one end in the predetermined direction of the elastic member body while the base portion is disposed at another end in the predetermined direction of the elastic member body.

4. The connector according to claim 3, wherein the rotation operating portion extends from the base portion in an opposite direction to the pressing portion and in the predetermined direction at a position separated from the predetermined plane in a direction perpendicular to the predetermined plane.

5. The connector according to claim 2, comprising a plurality of the contacts aligned in one straight line, wherein the elastic member includes a plurality of the elastic member bodies aligned in one straight line corresponding to the plurality of the contacts and the single rotation operating portion joined to the plurality of the elastic member bodies.

6. The connector according to claim 2, wherein the contact includes a projection portion and a flange formed at one end of the projection portion, and wherein the connector further comprises a first insulator provided with a contact through-hole, through which the projection portion of the contact is inserted and which is smaller than the flange.

7. The connector according to claim 6, wherein the first insulator includes a counter connector-accommodating portion for accommodating part of a counter connector.

8. The connector according to claim 6, further comprising a second insulator facing the first insulator across the flexible conductor and covering the rotation operating portion.

9. The connector according to claim 1, wherein the contact member is constituted by a contact unit in which a plurality of the contacts are aligned and held by a contact-insulator, wherein the contact unit includes a plurality of the conductor-contact portions constituted by parts of the plurality of the contacts, and the elastic member-contact portion, wherein the elastic member body includes a plurality of the base portions corresponding to the plurality of the contacts, and a plurality of the pressing portions disposed to be separated from the plurality of the base portions in the predetermined direction and being elastically displaceable in the predetermined direction with respect to the plurality of the base portions, and wherein the parts of a plurality of the flexible conductors are disposed between the plurality of the pressing portions and the plurality of the conductor-contact portions, the plurality of the base portions of the elastic member come into contact with the elastic member-contact portion of the contact unit, and the plurality of the pressing portions elastically displaced in the predetermined direction press the parts of the plurality of the flexible conductors against the plurality of the conductor-contact portions, whereby the plurality of the contacts are electrically connected to the plurality of the flexible conductors.

10. The connector according to claim 9, wherein the contact unit includes an elastic member body-accommodating portion of recess shape for accommodating the elastic member body, wherein the plurality of the conductor-contact portions are exposed at one end in the predetermined direction of the elastic member body-accommodating portion while the elastic member-contact portion is disposed at another end in the predetermined direction of the elastic member body-accommodating portion, wherein the plurality of the pressing portions are aligned at one end in the predetermined direction of the elastic member body while the plurality of the base portions are aligned at another end in the predetermined direction of the elastic member body, and wherein the elastic member body is accommodated in the elastic member body-accommodating portion with the plurality of the pressing portions being elastically displaced in the predetermined direction, whereby the plurality of the base portions of the elastic member come into contact with the elastic member-contact portion of the contact unit.

11. The connector according to claim 10, wherein the elastic member body includes a plurality of elastic pieces of cantilever shape aligned in a direction in which the plurality of the contacts are aligned, and wherein the plurality of the base portions are disposed at base end parts of the plurality of elastic pieces, and the plurality of the pressing portions are disposed at tip end parts of the plurality of elastic pieces.

12. The connector according to claim 11, wherein the rotation operating portion is joined to the plurality of the base portions and has a flat plate shape extending from the plurality of the base portions in an opposite direction to the plurality of the pressing portions and in the predetermined direction.

13. The connector according to claim 9, further comprising a second insulator facing the contact unit across the plurality of the flexible conductors and covering the rotation operating portion.

14. The connector according to claim 9, wherein the elastic member includes a guide portion formed on and projecting from the rotation operating portion, wherein the contact unit includes a guide receiving portion for accommodating the guide portion, and wherein the guide portion is accommodated in the guide receiving portion, whereby a position of the elastic member body to be accommodated in the elastic member body-accommodating portion is regulated.

15. The connector according to claim 1, wherein the flexible conductor is independently disposed between the pressing portion of the elastic member and the conductor-contact portion of the contact member.

16. The connector according to claim 1, wherein the flexible conductor is disposed to be exposed on a front surface of an insulating substrate body, and wherein the flexible conductor is disposed between the pressing portion of the elastic member and the conductor-contact portion of the contact member such that the flexible conductor faces the conductor-contact portion of the contact member and that a rear surface of the insulating substrate body faces the pressing portion of the elastic member.

17. The connector according to claim 1, wherein the contact is a plug-type contact.

18. The connector according to claim 1, wherein the contact is a receptacle-type contact.

19. A connecting method for connecting a contact of a contact member to a flexible conductor with use of an elastic member, the contact member including a conductor-contact portion constituted by part of the contact and an elastic member-contact portion disposed to be separated from the conductor-contact portion in a predetermined direction, the elastic member including an elastic member body and a rotation operating portion joined to the elastic member body, the elastic member body having a base portion and a pressing portion disposed to be separated from the base portion in the predetermined direction and being elastically displaceable in the predetermined direction with respect to the base portion, the connecting method comprising:

disposing the flexible conductor with respect to the contact member such that part of the flexible conductor is situated near the conductor-contact portion;

disposing the elastic member obliquely with respect to the contact member such that the pressing portion contacts the part of the flexible conductor and that the part of the flexible conductor is sandwiched between the conductor-contact portion and the pressing portion; and rotating the elastic member about the pressing portion that is in contact with the part of the flexible conductor through an operation of the rotation operating portion to bring the base portion of the elastic member body into contact with the elastic member-contact portion of the contact member so that the pressing portion elastically displaced presses the part of the flexible conductor against the conductor-contact portion, whereby the contact is electrically connected to the flexible conductor.

* * * * *